US008172251B2

(12) United States Patent
Holzer et al.

(10) Patent No.: US 8,172,251 B2
(45) Date of Patent: May 8, 2012

(54) SKI OR SNOWBOARD WITH MEANS FOR INFLUENCING ITS CROSS-SECTIONAL SHAPE

(75) Inventors: Helmut Holzer, St. Johann (AT); Bernhard Riepler, Wagrain (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 0 days.

(21) Appl. No.: 13/065,932

(22) Filed: Apr. 1, 2011

(65) Prior Publication Data

US 2011/0181023 A1 Jul. 28, 2011

Related U.S. Application Data

(62) Division of application No. 11/881,029, filed on Jul. 25, 2007, now Pat. No. 7,942,436.

(30) Foreign Application Priority Data

Jul. 26, 2006 (AT) ..... A 1268/2006

(51) Int. Cl.
*A63C 5/07* (2006.01)

(52) U.S. Cl. ..... 280/602; 280/609

(58) Field of Classification Search ..... 280/602, 280/608, 609, 11.16
See application file for complete search history.

(56) References Cited

U.S. PATENT DOCUMENTS

| | | | | |
|---|---|---|---|---|
| 3,326,564 | A * | 6/1967 | Heuvel | 280/602 |
| 5,301,965 | A * | 4/1994 | Floreani | 280/600 |
| 6,488,308 | B1 * | 12/2002 | Clausing | 280/602 |
| 6,626,444 | B2 | 9/2003 | Noble | |
| 6,886,848 | B2 * | 5/2005 | Riepler | 280/602 |
| 7,011,331 | B2 | 3/2006 | Riepler | |
| 2004/0026893 | A1 * | 2/2004 | Donze | 280/602 |
| 2004/0100067 | A1 * | 5/2004 | Riepler et al. | 280/602 |
| 2005/0006875 | A1 * | 1/2005 | Donze et al. | 280/602 |
| 2005/0073131 | A1 * | 4/2005 | Krumbeck et al. | 280/602 |
| 2005/0104328 | A1 * | 5/2005 | Emig et al. | 280/602 |
| 2005/0206128 | A1 * | 9/2005 | Gignoux | 280/602 |
| 2008/0106069 | A1 * | 5/2008 | Holzer et al. | 280/602 |

FOREIGN PATENT DOCUMENTS

AT 007 659 7/2005

(Continued)

*Primary Examiner* — J. Allen Shriver, II
*Assistant Examiner* — Erez Gurari
(74) *Attorney, Agent, or Firm* — Collard & Roe, P.C.

(57) ABSTRACT

A ski or a snowboard is in the form of a board-type gliding device. By reference to the width of the gliding device, at least one recess is provided in its middle portion extending in its depth direction from the top face of the gliding device in the direction towards the running surface facing and disposed in its longitudinal direction essentially parallel with the longitudinal direction of the gliding device with a view to causing a cross-sectional weakening. At least one manually adjustable adjusting device is provided, which is designed to produce an individually adjustable change in the load-dependent deformability of the cross-sectional shape or to produce an individually adjustable limit to the maximum permissible load-dependent cross-sectional deformation of the gliding device. Further, a ski or a snowboard is provided with a manually adjustable adjusting device which is designed to act as a spreading device for producing an individually adjustable increase in the width of the recess on the one hand and to act as a pulling device to produce an individually adjustable decrease in the width of the recess on the other hand.

16 Claims, 9 Drawing Sheets

FOREIGN PATENT DOCUMENTS

| | | |
|---|---|---|
| CH | 675 362 | 9/1990 |
| DE | 100 19 655 | 10/2001 |
| DE | 101 52 438 | 4/2003 |
| EP | 1 297 869 | 4/2003 |
| WO | WO 2006/049508 | 5/2006 |

* cited by examiner

SKI OR SNOWBOARD WITH MEANS FOR INFLUENCING ITS CROSS-SECTIONAL SHAPE

CROSS REFERENCE TO RELATED APPLICATIONS

This application is a divisional of and Applicants claim priority under 35 U.S.C. §§120 and 121 of U.S. application Ser. No. 11/881,029 filed on Jul. 25, 2007, which claims priority under 35 U.S.C. §119 of Austrian Patent Application No. A 1268/2006 filed Jul. 26, 2006, the disclosures of each of which are hereby incorporated by reference.

BACKGROUND OF THE INVENTION

1. Field of the Invention

The invention relates to a ski or a snowboard, with means for adjusting a cross-sectional geometry or contour which can be pre-set and varies depending on load and/or is manually variable.

2. Prior Art

Document AT 007 659 U2 proposes a ski, the running properties of which can be adapted by the respective skier. To this end, at least one recess is provided in the base body of the ski for interchangeably accommodating an insert. This insert, which can preferably be inserted in the recess in a positive fit, constitutes a composite body in conjunction with the base body, which determines the bending behavior of the ski. The purpose of these interchangeably insertable inserts is primarily to influence the bending behavior of the ski in its longitudinal direction and transversely thereto. The disadvantage of this approach is that it is necessary to provide a number of different inserts to enable the bending behavior of the ski to be individually varied in the respective desired direction.

Patent specification DE 100 19 655 A1 also describes a ski, and the user of a winter sports device, in particular a ski, can adapt it shortly after purchase to the respective intended purpose and can do so reversibly. To this end, it is proposed that the width and/or the contour of the winter sports device be designed so that it can be at least partially varied. In order to achieve this objective, it is proposed, amongst other things, that the winter sports device, in particular the ski, should be made up of several individual parts as viewed in cross-section, which can be varied in terms of their relative position with respect to one another. To this end, pivot shafts and mechanical guides are proposed. Another proposed alternative is to impart a cross-section of a wave-shaped or zigzag-shaped section to the winter sports device, in particular the ski, which extends in the transverse direction, i.e. across its width, and can be shortened. The disadvantage of this approach is that the proposed designs are technically complex and do not influence the travel behavior of such skis particularly satisfactorily under standard conditions of usage.

Patent specification U.S. Pat. No. 5,301,965 A also describes a ski, the cross-sectional geometry of which can be varied by a user as required. To this end, it is proposed that the degree of transverse curvature of the running surface facing be varied. This being the case, the running surface facing is permanently joined to the ski structure at the side edges only and its central portion is forced downwards relative to the lateral control edges by means of a plurality of screws. These screws for providing a vertical adjustment with respect to the running surface facing are inserted in so-called threaded inserts anchored in the ski structure and are spaced apart from one another at a distance of approximately 2 inches along the longitudinal mid-axis of the ski. The disadvantage of this approach is that the sub-structure of the ski is subjected to high local forces when the screws are actively forced towards the running surface facing and there is therefore an increased risk of overload. Furthermore, over longer periods of use or due to intensive changes in the geometry of the ski cross-section, there is an increasing problem due to the layers of the ski structure coming apart.

Patent specification U.S. 2005/0006875 A1 describes a ski, the cross-sectional geometry of which varies depending on load or is changed depending on load due to flexing caused by bending loads directed vertically with respect to the binding mounting portion. These cross-sectional changes occur automatically depending on how the ski flexes. To this end, at least one push rod is provided on the top face of the ski between the binding mounting portion and the ends of the ski, the relative displacement of which relative to the ski top face when the ski flexes is used to impart a concave shape to the ski bottom face in cross-section. This load-dependent deformation of the ski bottom face is caused by a plurality of force-transmitting arms mounted between the centrally extending push rod and the outer edges of the ski. Adjusting means are also proposed, by means of which the desired forward biasing action of the push rod on the transversely extending force-transmitting arms can be pre-set. Mechanisms are also provided which are able to protect against overload and define a threshold value for a maximum pushing force of the push rod. Another proposal is to provide local reductions in the thickness of the ski in the two side edge portions of the ski. The disadvantage of this is that the specified construction is mechanically complex and the overall weight of the ski is also significantly increased. Furthermore, the proposed adjusting mechanism is designed so that in spite of relatively short travel distances in the relative displacement between the push rod and the ski top face, sufficiently strong longitudinal pushing forces and transverse forces have to be produced simply to enable the side edge portions of the ski to flex downwards at all, thereby producing an essentially concave ski cross-section or a hollow neck-type running surface shape. Moreover, to an average skier using this construction which acts on the basis of load, barely any changes are experienced or perceptible as regards the traveling behavior during active use. The centrifugal forces acting on a skier's body are usually perceptible. However, these are primarily determined by the chosen travel speed and the selected radius of curvature.

Patent specification DE 101 52 438 A1 describes a snowboard, in particular a ski, the width of which can be varied along at least a part-portion of its length by means of a prizing mechanism. To achieve this, it is proposed that a continuous slot be provided in the ski starting from its rear end extending in the direction of the binding mounting portion, i.e. the ski has a slot-shaped orifice which is open towards its rear end, which is disposed coaxially with the longitudinal axis of the ski body and may be of a wedge-shaped design. This slot-type orifice in the ski is provided with an prizing mechanism for prizing apart the board body in the region of this slot. Positioning means are also proposed, by means of which the prizing means can be statically pre-set. It is also proposed that the prizing mechanism device be coupled with the binding mounting portion, in particular with the binding mounting plate, in order to obtain a load-dependent adjustment of the prizing mechanism. The disadvantage of this approach is that the slot-shaped orifice in the board body significantly reduces its strength, in particular its breaking strength, in its end portion and increases the risk of the layers of the ski coming apart due to water or similar penetrating the structure of the board body.

Patent specification U.S. Pat. No. 3,326,564 A, which is the prior art closest to the subject matter of the invention, describes a ski with a cross-sectional geometry which can be varied depending on load. The transverse or torsional strength of this ski is significantly reduced by means of a centrally extending recess or groove or by means of a plurality of recesses or grooves extending parallel with one another, disposed in the top face of the rearward portion of the ski behind the ski binding. When increased pressure occurs at the edges, in particular when a skier starts to turn in order to change direction of travel, an essentially V-shaped cross-section is imparted to this rear part-portion due to this specially designed weakening in the cross-section. This reduces the gripping hardness of the respective ski edge under load with respect to the ground underneath and results in a cross-sectional geometry which varies depending on load, thereby preventing excessive centrifugal forces during cornering using this ski. In particular, it reduces the grip of the side control edges depending on the prevailing load of the control edges as a function of the load at the control edges, which makes it easier for beginners or untrained persons to learn to ski and in particular to turn corners. At least one leaf spring may extend across the at least one groove-shaped recess, which is elastically connected to the top face of the ski with an elastic layer disposed in between. It is also proposed that a plate be provided on the top face of the ski with an elastic layer disposed in between, which is joined via laterally projecting flanges to vertically extending elongate holes and is connected to the side faces of the ski via several screw bolts extending through these elongate holes. The purpose of these plate-shaped elements on the ski top face is to produce a predefined restriction in the capacity of the ski cross-section to deform. The disadvantage of this approach is that this ski with its intrinsic travel properties does not satisfactorily cater for the individual requirements of different users. Furthermore, this ski also slips in the rear portion, especially under hard or icy conditions, which results in a sudden risk of over-rotating when cornering and the skier can easily lose control.

Patent specification WO 2006/049508 A1 describes a ski or a snowboard with a running sole which has an originally flat cross-section. This board-type gliding device has a zone or several zones within its longitudinal extension with at least one recess in its top face, and these recesses constitute a reduction in cross-section and are intended to form defined deformation zones for raising the left and/or right portion of the board relative to its cross-sectional shape. Accordingly, the lateral, outer steel edges of the board are raised relative to its central portion by means of a tension means disposed on the top face of the board and imparts an individually adjustable tensioning action transversely to the longitudinal extension of the board, which causes the side portions of the board to bend upwards relative to the portion of the board running along the center. A board of this type can only be used without problems under certain conditions, in particular if the snow on the ground underneath is relatively soft. In the case of relatively hard ground, the travel behavior of such a ski or snowboard is impaired and its control behavior is not very satisfactory.

OBJECTIVES AND ADVANTAGES OF THE INVENTION

The objective of this invention is to propose a ski or a snowboard, which has travel properties which can be manually varied and/or which vary depending on load, and which exhibits a high capacity for day to day use or robustness but can nevertheless be manufactured inexpensively.

This objective is achieved by the invention on the basis of a board-type gliding device based on the characterizing features defined in one aspect of the invention. The advantage of this approach is that the end user or a dealer or a hire company can more readily adapt the ski proposed by the invention or the snowboard proposed by the invention to individual wishes and to whatever conditions are prevailing in terms of travel properties, in particular to the quality of the ski slope. For example, if relatively hard or icy conditions prevail on the ski slopes, it is of advantage to set the adjusting means so that the change in cross-sectional shape which occurs under the prevailing loads is relatively slight, which enables a good edge grip to be obtained and hence the most accurate possible guidance of the ski or snowboard. By contrast, the same gliding device can be set, especially in the case of soft conditions on the ski slope, so that a relatively easy deformability occurs in the cross-section under the prevailing loads, so that a relatively more pronounced change occurs in the contour or the so-called sidecut of the ski or snowboard whilst the user is turning a corner. The ability to individually adjust or adapt the load-dependent variability of the ski or snowboard cross-section also means that an optimized travel or cornering behavior of the board-type gliding device can be achieved. In particular, the ski can be switched to suit individual wishes or requirements between a relatively aggressive or track-following travel behavior and a softer travel behavior that is more forgiving of errors with a more pronounced slip behavior of the side edges. Such a ski or such a snowboard is also better able to cater for the often differing ideas of different users. Furthermore, such a ski or such a gliding device is of particular interest for both hire companies and for individualists with briefly changing wishes in terms of travel behavior. Another specific advantage is that the user of the ski or snowboard can be protected against excessive loads or forces. In particular, depending on the setting chosen for the load-dependent cross-sectional deformability or the setting restricting the maximum permitted, load-dependent cross-sectional deformability, the radius of curvature assumed by the ski or snowboard under such load can be varied, in particular increased. In particular, it is possible to set up an arrangement whereby in the event of high edge pressure or high centrifugal forces, the edge grip becomes increasingly weak so that the ski or snowboard is increasingly switched into a slip phase. Especially in the case of skis or snowboards with pronounced contours or small lateral radii in the initial state, as is the case in particular with carving skis, the load acting on the body of the skier can be limited, thereby reducing the risk of injury to the skier. Of particular advantage is the fact that the boundary between a particularly aggressive or track-following travel behavior and a throttled edge grip of the ski or snowboard that is much more forgiving of errors can be varied individually by means of the adjusting means.

Irrespective of the above, the objective of the invention is also achieved by a board-type gliding device based on the characterizing features defined in another aspect of the invention. The advantage of this approach is that the ski or snowboard can be varied in terms of its travel behavior from its basic position, predefined by its construction or how it is made, using individually adjustable adjusting means, resulting in a perceptible difference. One advantage of this is that a concave running sole is imparted to the ski proposed by the invention or the snowboard proposed by the invention if the adjusting means is used as a prizing means, so that the side or control edges of the board-type gliding device are more active than the middle portion of the running surface facing. In particular, by activating the prizing means, the aggressiveness or tracking guide and edge grip of the ski or snowboard are increased. The adjusting means can also use its pulling means function to switch the running sole or the running surface facing to a convex shape. In other words, in this other position of the adjusting means, the side control or steel edges of the board-type gliding device are raised above the central longitudinal portion of the running surface facing so that a travel behavior with a reduced edge grip or an increased slip behavior is assumed which is more tolerant of certain travel or load errors of the skier. The switch between a relatively high and relatively low edge grip—compared with the edge grip of the ski or snowboard in its initial state when the running sole is essentially flat—permits an optimized adaptation of the travel properties to the respective usage conditions and to the individual wishes of different users. A ski or snowboard of this type is therefore also particularly suitable for hire or loan. Irrespective of this, the owner of such a ski or snowboard can adapt the respective gliding device briefly and without problems to suit changing conditions of usage or changing requirements depending on travel behavior. The gliding device, which can be varied in terms of its cross-sectional geometry or contour as necessary, is therefore suitable for day to day use and is robust and can be produced inexpensively using tried and tested production methods. In particular, the design and construction methods which have proven themselves over many years can continue to be used, so that a reliable sports device with a travel behavior which can be varied or adapted to a limited degree is produced.

The advantage of the design defined in another aspect is that the top layers of the gliding device, in particular the layers constituting the top belt, can be easily moved apart from one another in the transverse direction with respect to the gliding device and can also be moved towards one another, thereby achieving a noticeable or sufficiently pronounced change in the cross-sectional shape of the ski or snowboard. In particular, an appropriate cross-sectional change can be achieved using relatively lightweight adjusting means of a simple design.

Also of advantage is an embodiment where the stability and strength of the board-type gliding device which can be achieved is sufficiently high, thereby making it very suitable for everyday use. It also ensures that the running sole of the gliding device is bounded by at most two outer side edges, thereby imparting a familiar travel behavior and one which can be anticipated. By contrast with this, separate running surface facings or split running soles with several side edges would result in evident disadvantages in terms of the robustness and guiding action of the board-type gliding device.

The advantage of the features defined in a further embodiment is that an optimum situation can be achieved between the desired cross-sectional deformability and strength or robustness due to the proven construction of the board-type gliding device.

The features defined in a further embodiment are of advantage because the change in the contour of gliding device is guaranteed to be as homogeneous and uniform as possible.

Also of advantage is an embodiment where in spite of a relatively short longitudinal extension of the recess, a particularly pronounced influence can nevertheless be achieved on the travel behavior, especially with regard to the degree of adjustment which can be achieved. These changes in travel behavior emanating from the front part-portion of the ski or snowboard are still much easier for the skier to control because the design of the recess in the front part-portion tends to lead to a gradually occurring under-control which can be controlled more easily and which can be counteracted by the skier with relatively little difficulty. However, such a design does not lead to a sudden over-control of the ski and does not cause a potentially dangerous "turning-in" of the skier due to the rear ski or snowboard portion suddenly sliding away.

The features defined in a further embodiment are also of particular advantage because the transverse stiffness of the ski or snowboard can be noticeably influenced using simple structural features, and in particular the requisite desired value can be reduced. The shovel portion, which is relatively stiff due to its curvature, can be better or more easily elastically deformed as a result, in other words in the direction extending transversely to the longitudinal extension of the gliding device, and above all can be deformed within a relatively wide adjustment range about its axis extending in the longitudinal direction, which is preferably centrally oriented. In particular, relatively broad setting or variation ranges can be achieved with respect to the so-called "sidecut" or active contour radius of the gliding device without increased risk of placing excessive strain on the structure of the gliding device or without the need for complex structural features. In other words, as a result of these features, the maximum achievable cross-sectional change may be relatively pronounced even if the effect of force applied via an adjusting means is only moderate or average or under the loads which occur during travel.

Also of advantage is an embodiment where a sufficient cross-sectional weakening can be achieved along the longitudinal mid-axis of the gliding device, with a view to permitting the desired, elastically rebounding cross-sectional deformations. Furthermore, the fact that the depth of the recess becomes shorter in the direction towards the ends of the gliding device means that the gliding device is completely separated or slotted at its end portions.

Also of advantage is another embodiment where a top layer of metal or plastic may easily be fitted as a lining for the recess, thereby offering advantages in terms of production methods.

A further embodiment is of advantage because the extent of cross-sectional variation dependent on load and hence also the corresponding change in the contour can be adapted to suit the individual requirements of the skier. This adjustable change in contour also makes it easier to make allowance for the respective skiing skills of an end user. There are also advantages in terms of handling and storage in the case of businesses hiring sport articles.

The advantage of a further embodiment is that a ski or snowboard is obtained which offers a number of options in terms of varying its travel properties. In particular, an individually desired initial setting of the cross-sectional geometry may be used. At the same time, a deformability of the ski or snowboard depending on load can be selected with respect to its cross-sectional geometry to satisfy respective wishes or recommendations.

Due to the features defined in a further embodiment, the board-type gliding device can be easily and individually switched between a deployment state exhibiting a high transverse stiffness and a deployment state with a relatively low transverse stiffness. In particular, the travel and cornering behavior of the gliding device can be changed using simple but effective means.

The advantage of another embodiment is that an initial setting of the cross-sectional geometry can be set which will have corresponding implications with regard to a relatively stronger or weaker edge grip of the ski or snowboard.

The advantage of another embodiment is that it additionally offers options for individually adjusting the edge grip and the contour of the ski or snowboard. In particular, the side control edges of the ski or snowboard can be raised relative to the central running surface portion if necessary and then returned to the original initial position.

A particularly robust and advantageous structural embodiment of the adjusting means is defined in a further embodiment. In particular, the high adjustment forces which can be achieved as a result can be transmitted between the adjusting means and the board-type gliding device without the need for complex or expensive modifications to the ski or snowboard.

Sufficiently strong thrust-bearing surfaces can also be retrospectively fitted on the board-type gliding device, and if necessary on prefabricated gliding devices, as specified in a further embodiment. Also of advantage is the fact that by means of the projections on the top face of the gliding device, a particularly forceful pulling and pushing effect can be achieved in conjunction with the adjusting means when conducive levering ratios prevail, if the projections stand proud of the top face of the gliding device.

A further embodiment enables the support function of the support means to be easily activated and deactivated. This embodiment is of a simple structural design as a result and can thus be produced inexpensively.

By means of a further embodiment, the action of the support means relative to the ski or snowboard can be varied in a sufficiently wide adjustment range. In particular, a selection can easily be made between a relatively low and high transverse stiffness of the gliding device.

Also of advantage is another embodiment, because it enables the action of the support means to be steplessly adjusted. In particular, the support means can be individually adjusted between an inactive position and several active positions. Another advantage is the fact that no tools are needed in order to move the support means into the respectively desired position as a rule.

A further embodiment is also of advantage because the support function of the adjusting means has a structurally simple and effective activation and deactivation system. This adjusting means can also be used as a damping element in order to damp movements reducing the width of the recess and expend an elastic resistance to such tendencies.

Of particular advantage is another embodiment, because high adjusting forces can be applied in order to achieve the desired cross-sectional change to a corresponding degree.

Also of particular advantage is another embodiment, because the respective adjustment of the adjusting means can be undertaken at any time without the need for aids. In particular, a change can be easily made to the travel properties of the ski or snowboard, including when stopping on any part of the ski slope.

Another embodiment is of advantage because the support means may be fitted on the gliding device so that it is not conspicuous. It is also of particular advantage that an effective supporting action can be generated without the need for special structural precautions. Another advantage is that there are no peg-type parts standing up from the top face, which means that the risk of injury from the adjusting means, which is mounted in a predominantly recessed arrangement, is particularly low.

A further embodiment offers a functionally reliable and structurally robust mounting for the support means. It also results in an uncomplicated and generally easily recognizable functionality of the adjusting means.

Another embodiment is of advantage because the effect of the support means can be easily varied and the support element is robust and inexpensive at the same time.

Also of particular advantage is a further embodiment because the supporting effect of the support means can be easily varied or regulated. Using the wedge effect also results in a structurally simple and robust adjusting means. Particularly if the support means is forced into the recess with a sufficient biasing action or force, this wedge-type support means may also operate as a prizing means for varying the cross-sectional geometry of the gliding device.

The particular advantage of a further embodiment is that pushing and pulling forces can be produced by applying low displacement forces with the support means. This approach also obviates the need for additional catch or locking features as a means of reliably retaining the respectively desired setting.

Also of advantage is a further embodiment because it is suitable for extensive day to day use and the risk of layers of the sandwich construction of the ski or snowboard coming apart can be virtually ruled out. An attractive appearance is also obtained as a result and a number of design options are possible.

Finally, a further embodiment is of advantage because it offers a gap-free top layer, thereby reliably preventing moisture from getting in. Using a top layer comprising a single part also makes production easier.

BRIEF DESCRIPTION OF THE DRAWINGS

Advantageous embodiments of the invention will be described in more detail with reference to examples of embodiments illustrated in the appended drawings.

Of these.

Figure 1:
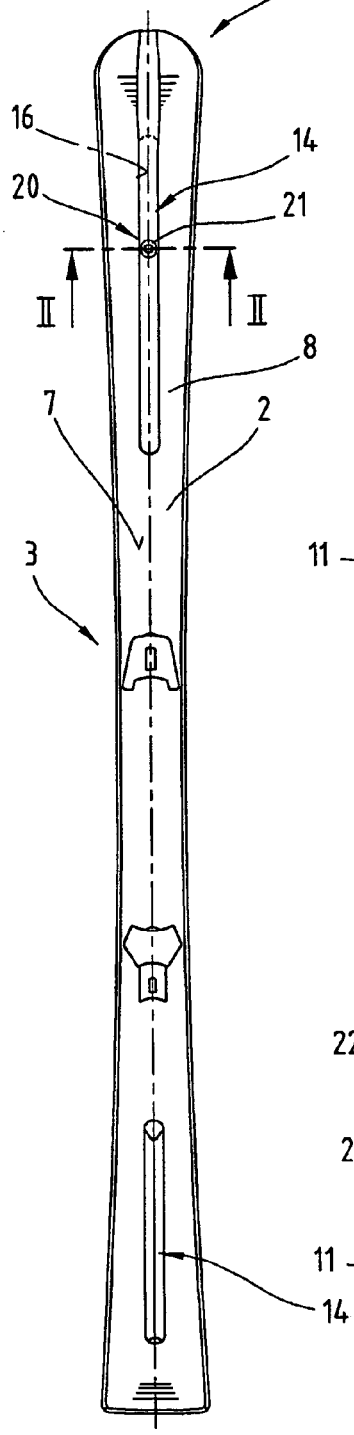
FIG. 1 is a simplified plan view of an example of a ski with recesses extending longitudinally along its center for producing a cross-sectional geometry which varies depending on load and with an adjusting means for manually pre-setting the individual way in which the load-dependent variability can be influenced.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
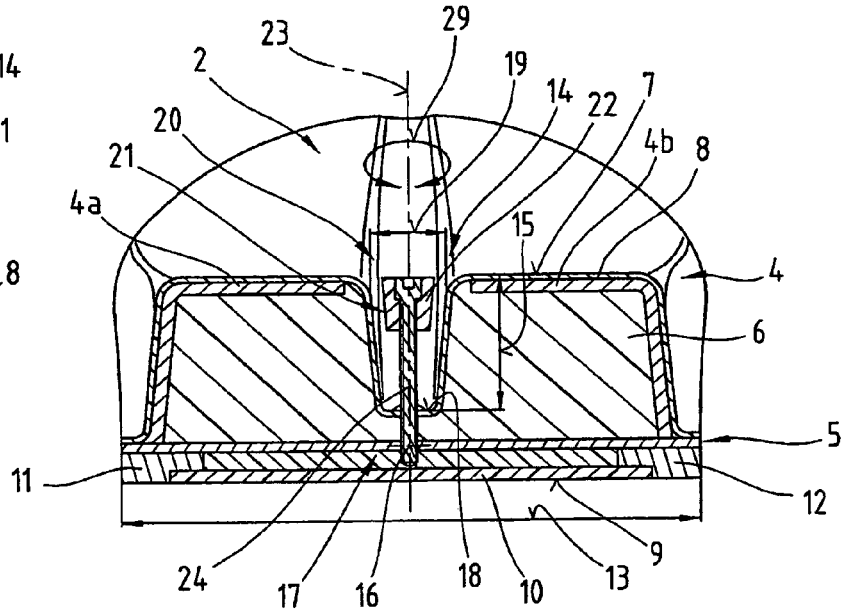
FIG. 2 is a simplified schematic diagram of the ski illustrated in FIG. 1, viewed in section along line II-II indicated in FIG. 1, when the adjusting means assumes a first position.
Figure 3:
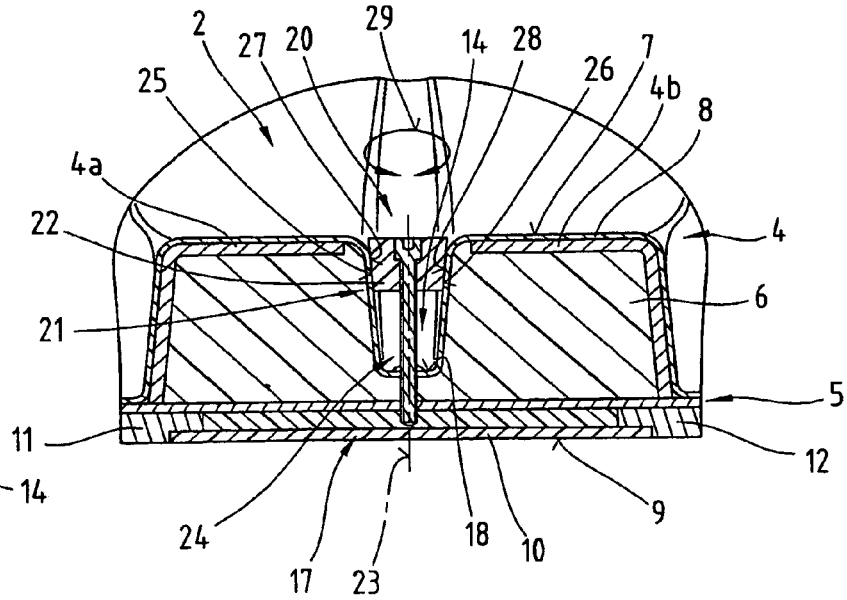
FIG. 3 illustrates the same ski as that illustrated in cross-section in FIG. 2 when the adjusting means has assumed a second position.

FIGS. 1 to 3 illustrate one embodiment of a board-type gliding device 1 with a geometry which varies depending on load. In particular, the schematically illustrated ski 2 has a cross-sectional geometry or contour which varies depending on the prevailing load when upended on the lateral control edges.

By preference, the board-type gliding device 1 is a ski 2 or a snowboard. In a known manner, such a ski 2 is used in pairs, whereas the user of a snowboard is supported with both feet on a single board body. In order to connect the feet of the user to the gliding device 1, the latter has a least one binding mechanism 3, which may be designed as a safety-release binding or a binding which provides a coupling without flexing.

The board-type gliding device 1 is based on a sandwich or monocoque structure. In other words, a plurality of layers are joined to one another by adhesive and together constitute the one-piece gliding device body. In a known manner, these layers form at least one top belt 4 which imparts strength, at least one bottom belt 5 which imparts strength and at least one core 6 disposed in between. The top belt 4 and/or the bottom belt 5 may be made from at least one plastic layer and/or metal layer and/or fiber layer and/or epoxy resin layer and such like. In a known manner, the core 6 may be made from wood and/or from foamed plastics. The core 6 therefore essentially spaces the top belt 4 apart from the bottom belt 5 of the gliding device 1, both of which are impart strength.

The top face 7, i.e. the top external face of the gliding device 1, is formed by a top layer 8, which primarily fulfils a decorative function. The bottom face 9, i.e. the bottom surface of the gliding device 1, is formed by a running surface facing 10, which should have the best possible gliding properties with respect to the ground underneath, in particular with respect to snow or ice. In this respect, the top layer 8 may also extend across at least certain regions of the side faces of the board-type gliding device 1 and form a box-type structure in conjunction with the running surface facing 10, as may be seen in particular from the diagram in cross section shown in FIG. 2 or 3. The side edges of the running surface facing 10 are preferably bounded by control edges 11, 12, preferably made from steel, to permit an exact as possible and largely slip-free guiding action of the gliding device 1, including on relatively hard ground. The control edges 11, 12 which are key to controlling and guiding the gliding device 1, are rigidly joined to the structure, in particular to the running sole or bottom belt 5 of the gliding device 1. The control edges 11, 12 are preferably positively and non-positively fixed in the gliding device structure in a manner known per se. Similarly, the running surface facing 10 is permanently joined to the gliding device structure, in particular to its bottom belt 5, across its entire top flat face. The running surface facing 10 is preferably adhered to the surrounding components of the gliding device 1 by its entire surface. The running surface facing 10 or bottom face 9 of the gliding device 1 is of a flat or straight design in cross-section, as illustrated in FIG. 2, when the gliding device 1 is in its original state not placed under load, in which case the gliding device 1 in the initial state free of load has an essentially flat bottom face 9 and running sole.

The structure described above is decisive in determining the strength, in particular the bending behavior and torsional stiffness, of the board-type gliding device 1. These strength values are predefined or predetermined by the materials used and layer thicknesses and by the methods used for joining purposes. The essential factor is that the specified board-type gliding device 1 has at least one means which produces a cross-sectional geometry or contour of the gliding device 1 which is variable depending on load and/or can be manually varied and in particular can be pre-set. By reference to the width 13 of the gliding device 1, at least one recess 14 is provided in the middle portion of the gliding device 1 for this purpose, which extends with respect to its depth direction—arrow 15—from the top face 7 of the gliding device 1 in the direction down towards the running surface facing 10. By reference to its longitudinal direction, the at least one recess 14 extends essentially parallel with the longitudinal direction of the gliding device 1, as may best be seen from FIG. 1. The at least one recess 14 along the longitudinal central portion of the ski 2 is dimensioned and designed so that it causes a cross-sectional weakening of the gliding device and in particular reduces the stiffness of the gliding device 1 transversely to its longitudinal direction.

As may best be seen from FIG. 1, the recess 14 is provided at least in the front portion, i.e. in the part-portion between the binding mechanism 3 and the front end of the gliding device 1. If necessary, such a recess 14 may also be provided in the rear portion of the gliding device 1, i.e. in the portion between the binding mechanism 3 and the rear end of the gliding device 1. Alternatively, the at least one recess 14 may also extend across a binding mounting portion of the gliding device 1, i.e. continuously from the front end of the gliding device 1 in the direction towards the rear end of the gliding device 1.

The essential aspect is that, in terms of the statics or strength of the gliding device 1, the at least one recess 14 sub-divides or splits the relevant top belt 4 essentially within the longitudinal extension of the recess 14 into a first or left-hand and a second or right-hand top belt strand 4*a* and 4*b*. In other words, due to the design of the recess 14, the top belt 4 is interrupted or severed and split into at least two top belt strands 4*a*, 4*b*. The strength-imparting top belt 4 is therefore interrupted or split by means of the recess 14 so that the transverse stiffness of the gliding device 1 is essentially reduced and in particular permits a flexing of the side portions of the gliding device 1 about an imaginary axis 16 extending in the longitudinal direction of the gliding device 1 and essentially parallel with its running surface facing 10 when the gliding device 1 or the ski 2 is exposed to corresponding edge loads. In particular, a deformation portion 17 is formed, in which the imaginary virtual axis 16 lies. As may best be seen from FIG. 2, a cross-sectional zone between the base 18 of the recess 14 and the running surface facing 10 specifically forms an elastic, in particular joint-type, deformation portion 17 which changes the cross-sectional shape of the gliding device 1. This elastic deformation portion 17 of the ski 2 is specifically defined by the longitudinal central portion of the bottom belt 5 and the running surface facing 10. The essential aspect is that the recess 14 which weakens the cross-section extends from the top face 7 in the depth direction—as indicated by arrow 15—down to close to the bottom belt 5 or even weakens or reduces the cross-section of the bottom belt 5. However, the recess 14 is not so deep that it also extends through the running layer facing 10. In other words, the running surface facing 10 is unaffected by the recess 14, at least within the entire longitudinal extension of the recess 14, and extends from the left-hand side edge of the gliding device 1 through to the right-hand side edge of the gliding device 1, as may be seen from FIG. 2 or 3. Accordingly, a running sole of the gliding device 1 is formed, which essentially comprises the bottom belt 5 and the running surface facing 10. It is therefore preferable to avoid a cut or total slot through the gliding device 1.

As may also be seen from the schematic diagram show in FIG. 2, the recess 14 forms the elastic deformation portion 17 starting from the top face 7 of the gliding device 1 in the region of the bottom belt 5, the elasticity of which is dependent on the intrinsic elasticity of the gliding device 1 in this portion. The elastic deformation portion 17 therefore constitutes a sort of film hinge connection between the portion of the gliding device 1 lying to the left-hand side of the recess 14 and to the right-hand side of the recess 14. In order to produce an appropriate elastic cross-sectional deformation under real conditions of deployment or loads of the gliding device 1, the recess 14 extends across 50% to 90%, preferably across ca. 75%, of the biggest cross-sectional height of the gliding device 1 within this cross-sectional plane in order to produce a conducive transverse stiffness and to produce an optimal ability to flex. In addition, the recess 14 or several recesses 14 aligned in a row in the longitudinal direction of the gliding device 1 should extend across 40 to 80%, preferably across approximately 60%, of the length of the gliding device 1. Alternatively or in combination with this, the recess 14 may extend across 50% to 90%, preferably across approximately 75%, of the portion between the binding mechanism 2 and the front end of the gliding device 1.

It is of particular advantage if the recess 14 extends into the front shovel portion of the ski 2 and is also disposed in the shovel portion, as illustrated by way of example in FIG. 1. In particular, the recess 14 may extend through the front shovel portion continuously as far as the front end of the ski tip. The upwardly curved shovel portion, which has a relatively high transverse stiffness due to this curvature, is therefore significantly influenced in terms of its torsional or transverse stiffness, thereby enabling the stability requirements of such a ski 2 to be fulfilled on the one hand and enabling a change to be obtained in the cross-sectional geometry to the desired degree under the loads which occur during use and under the effect of adjustment forces of an individually adjustable adjusting means 20 on the other hand. On average, this enables changes of up to 6 m to be obtained in the effective radius of curvature of the ski 2. In particular, a change in the range of several meters can be produced in the contour radius of the ski 2, without the need for features which are structurally complex and expensive or significantly increase the weight of the ski 2. Such an adjustment range for the effective radius of curvature which can be achieved with such a ski 2 using its control edges 11, 12 on co-operating ground underneath comprising snow is clearly felt or perceived, even by users with average skiing ability and users who ski only occasionally. This significantly increases the acceptance of and pleasure in using such skis 2.

The depth 15 of the recess 14 preferably decreases from the binding mounting portion or from the binding mechanism 3 in the direction towards the end or in the direction towards the ends of the gliding device 1. A width 19 of the recess 14 preferably also reduces from the top face 7 of the gliding device 1 in the direction towards the running surface facing 10. In other words, the recess 14 preferably extends in a wedge shape in the direction towards the running surface facing 10 and the biggest width 19 is disposed in the transition region to the top face 7 of the gliding device 1. The base 18, i.e. the bottom, of the recess 14, is either designed in the form of a crease or is rounded, as illustrated by way of example in FIG. 2.

As may also be seen from the diagrams shown in FIGS. 1 to 3, the board-type gliding device 1 has at least one adjusting means 20, which is provided as a means of individually and adjustably varying or influencing the stiffness of the gliding device 1 transversely to its longitudinal direction. In the embodiment illustrated as an example, the adjusting means 20 is designed so that it can selectively permit or prevent a variation in width 19 or a variability in the width 19 of the recess 14 depending on load. To this end, the adjusting means 20 has at least one support means 21. This support means 21 is illustrated in the inactive position in FIGS. 1 and 2, whereas the support means 21 is illustrated in an active position in FIG. 3. In the embodiment illustrated as an example, the support means 21, which can be activated and deactivated as and when necessary, is provided in the form of at least one support element 22 of a cam-type design and is mounted so that it is able to pivot about an axis 23 extending substantially perpendicular to the running surface facing. In the embodiment illustrated as an example, this axis 23 is formed by a bolt-type support body 24, which is secured so that it is able to rotate relative to the base 18 of the recess 14 or is rigidly anchored in the deformation portion 17 of the gliding device 1. For this purpose, it would be conceivable to use simple screw anchoring systems or anchor-type inserts within the deformation portion 17 in order to produce a sufficiently stable disposition of the support body 24 and its support element 22 in the top head portion of the support body 24 within the recess 14.

The support means 21, in particular the cam-type support element 22, has at least two support surfaces 25, 26 lying opposite one another, as illustrated in FIG. 3. These at least two support surfaces 25, 26 on the outer circumference of the support element 22 are provided as a means of affording mutual support for the oppositely lying longitudinal side walls 27, 28 of the recess 14. In other words, when the support means 21 is in the active position—illustrated in FIG. 3—the support surfaces 25, 26 either prevent the longitudinal side walls 27, 28 from moving towards one another, i.e. thus reducing the width 19 of the recess 14, or afford a higher mechanical resistance against such a reducing movement. In particular, in its active position, this cam-type support means 21 acts as a supporting block or prizing element between the mutually opposite longitudinal side walls 27, 28 of the groove-type recess 14.

FIGS. 1 and 2 illustrate the inactive position of this support means 21. On assuming this inactive position, the support surfaces 25, 26 of the support element 22 are spaced at least at a slight distance apart from the longitudinal side walls 27, 28 of the recess 14. This means that when this position is assumed, the longitudinal side walls 27, 28 are able or allowed to move closer to one another when an elastic deformation of the gliding device 1 occurs within its deformation portion 17.

As illustrated by the plan view shown in FIG. 1, the support element 22 may be of an elliptical design and has at least two oppositely lying support surfaces 25, 26. Alternatively, the support means 21 may also have a plurality of support surfaces in the form of a polygon which can be activated as and when necessary. Depending on the distance of these support surfaces from the axis 23, the supporting action is weaker or stronger. In particular, the extent of the free elastic deformation of the deformation portion 17 can then be selectively reduced or increased. This means that, depending on the distance between the support surfaces of the support means 21 and the longitudinal side walls 27, 28 of the recess 14, a more or less pronounced transverse bending of the gliding device 1 is permitted until the longitudinal side walls 27, 28 finally move into abutment with the co-operating support surfaces. The essential factor is that the support means 21 is eccentrically mounted or is provided in the form of a rotationally non-symmetrical body, for example in the form of a cam or body of polygonal shape. In other words, the support element 22 may also be designed as an eccentric cam, an element with a plurality of teeth or similar.

This support means 21 may also be either inflexible or elastically flexible, in order to permit a certain springing action of the transverse deformation of the gliding device 1. If the individually adjustable support means 21 is of a rigid design, a rigid blockade or a defined stop restriction can be achieved to produced deliberately permitted transverse deformations of the gliding device 1.

Retaining means are preferably provided in the form of at least one catch, in order to hold the support means 21 in its inactive position and/or in at least one of its active positions with a predefined retaining force and in order to prevent any undesirable adjusting movements of the co-operating adjusting means 20 of its own accord. All catch mechanisms or other types of locking mechanism known from the prior art may be used for this purpose. In particular, these catch or snap mechanisms should prevent any undesirable twisting of the support means 21 about the axis 23, i.e. along double arrow 29.

The cross-section of the cam-type or polygon-shaped support element 22 may be adapted to the cross-sectional contour of the recess 14. In other words, the support element 22 may be of a wedge-shaped or trapezium shape in cross-section in order to provide support surfaces 25, 26 affording a large surface area with respect to the longitudinal side walls 27, 28, as illustrated by way of example in FIG. 3.

As may be seen in FIG. 1, at least one support means 21 is disposed inside the recess 14, which can be activated and deactivated as required. It is preferably disposed more or less in the middle portion of the length of the recess 14. Alternatively, another option would be to provide a plurality of support means 21 inside the recess 14 which can be adjusted independently of one another or a plurality of support means 21 which are coupled for adjustment purposes to enable the transverse stiffness of the board-type gliding device 1 to be influenced within a longer longitudinal extension.

The distance between at least two diametrically opposite support surfaces of the support element 22 may optionally also be slightly bigger than the width 19 of the recess 14 in the no-load state, i.e. when the ski 2 is in the non-operating state. When this adjustment system or these support surfaces is or are activated, the non-operating dimension of the width 19 of the recess 14 can be made at least slightly bigger. In this case, the support means 21 additionally serves as a prizing means, as will be explained in more detail below.

Figure 4:
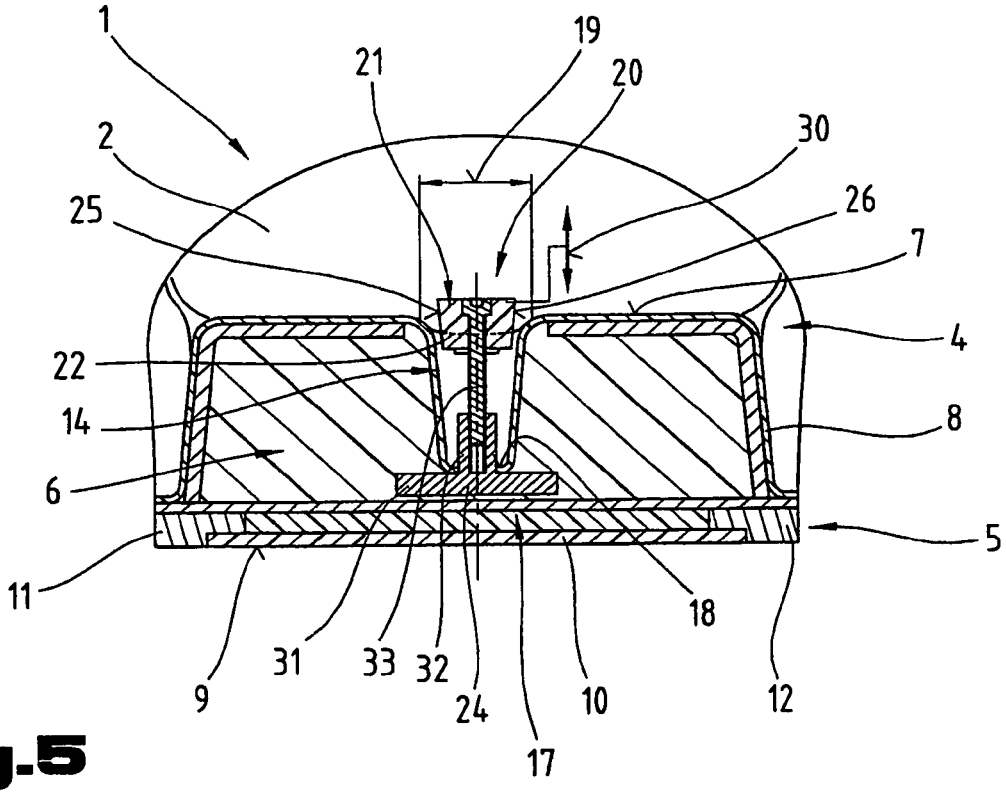
FIG. 4 is a highly simplified diagram in cross-section showing an example of another embodiment of a ski with a recess extending longitudinally along its center and another embodiment of an adjusting means.
Figure 5:
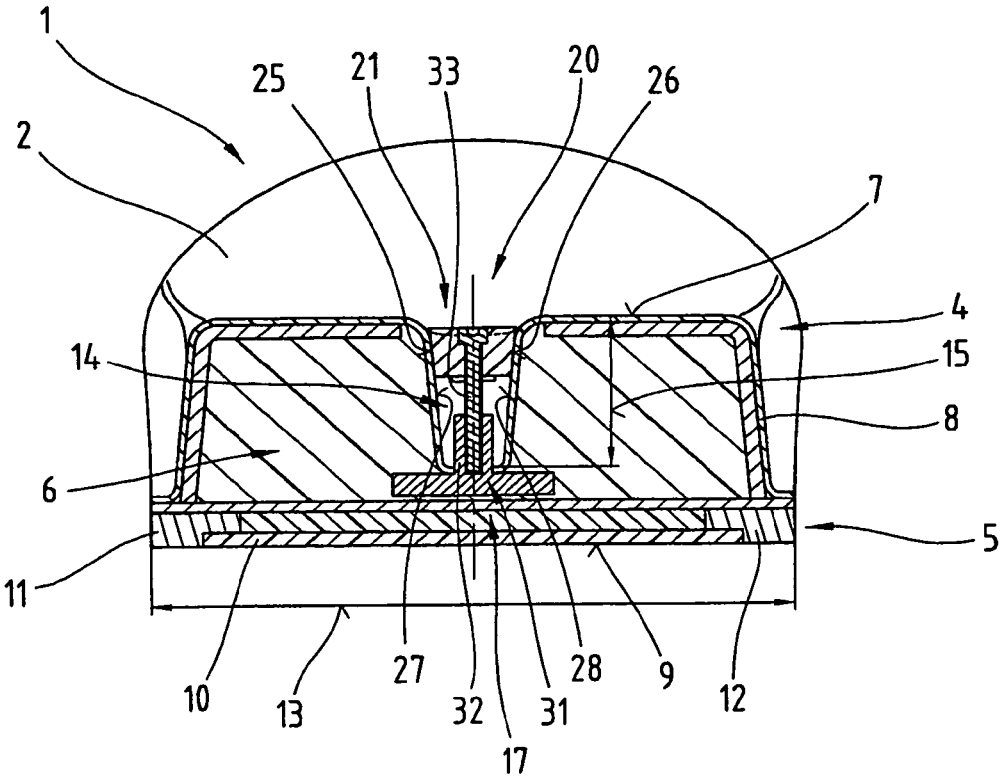
FIG. 5 shows the ski illustrated in the diagram in section in FIG. 4 when the adjusting means has assumed a different position.

FIGS. 4 and 5 illustrate a different embodiment of the adjusting means 20, in particular in terms of the support means 21 used to support the mutually opposite longitudinal side walls 27, 28 of the recess 14. Instead of the rotatable mounting or adjustability of the support means 21 described above, the support means 21 illustrated in FIGS. 4, 5 can be displaced in the direction of double arrow 30 in the vertical direction towards the bottom face 9 of the ski 2 and in the vertical direction towards the running surface facing 10 and individually adjusted and fixed. To this end, the pin-type or bolt-type support body 24 for the support element 22 is provided in the form of part of a threaded spindle arrangement. In particular, the support element 22 and its support portions or support surfaces 25, 26 can be raised and lowered via this threaded spindle arrangement or thread design in the direction of double arrow 30 relative to the base 18 of the recess 14. For example, a flange nut arrangement 31 may be provided inside the deformation portion 17 or some other anchoring for a threaded bush 32. By means of this flange nut arrangement 31 or threaded bush 32, a threaded pin 33 can be mounted so that its height can be adjusted. The threaded pin 33 will then support the support element 22 or a co-operating support cam at its top end portion, thereby enabling the support element 22 to be positioned and individually adjusted in the vertical direction indicated by double arrow 30.

In the embodiment illustrated as an example in FIGS. 4 and 5, the support element 22 of the support means 21 is of a frustoconical design, i.e. it has a circular contour as seen in plan view and defines a trapezium-type shape in cross-section.

When the support means 21 is in the active position illustrated in FIG. 5, the mutually opposite longitudinal side walls 27, 28 of the recess 14 are supported on the oppositely lying support surfaces 25, 26 of the support means 21 and transmit load.

When the support means 21 is in the inactive position illustrated in FIG. 4, a defined cross-sectional deformation of the gliding device 1 takes place. In particular, the two top belt strands 4*a*, 4*b* on either side of the recess 14 move towards one another when the ski 2 is subjected to a corresponding load until the top edge portions of the recess 14 sit in abutment with the support means 21. As a result, with this embodiment, the distance between the support surfaces 25, 26 and the longitudinal side walls 27, 28 can be individually varied in a simple manner, because the distance of the support element 21 with a wedge-shaped cross-section is varied relative to the base 18 of the recess 14. This can easily be achieved in two directions—indicated by double arrow 30—by means of the threaded coupling of the threaded pin 33 and the threaded bush 32.

This also enables the support element 22 to be firmly or forcefully driven by means of the thread arrangement into the recess 14 with a wedge-shaped cross-section, thereby causing the recess 14 to widen, i.e. increasing the width 13, and thus causing a change in the cross-sectional geometry. In this situation, the running surface facing 10 or the bottom face 9 of the ski 2 assumes a concave shape in cross-section, as a result of which the control edges 11, 12 of the gliding device 1 are improved or rendered more aggressive. In other words, the embodiment illustrated in FIGS. 4 and 5 also enables the width 19 of the recess 14 to be increased by prizing open the recess 14 in the region of the top face 7 when the support element 22 is forced into the wedge-shaped recess 14 with sufficient driving force. This means that with the adjusting means 20 illustrated in FIGS. 4 and 5, the support means 21 can be forced into the recess 14 by the keying action. To this end, at least the recess 14 is provided with a wedge-shaped cross-section, and the recess 14 tapers starting from the top face 7 in the direction towards the bottom face 9 of the gliding device 1. In this respect, it is of advantage if the support element 22 is also of a wedge-shaped design and likewise tapers from the top face 7 in the direction towards the bottom face 9 of the gliding device 1. Furthermore, it is also of practical advantage if the respective keying surfaces, i.e. the support surfaces 25, 26 and the longitudinal side walls 27, 28, have at least approximately the same pitch or an at least approximately identical angle of inclination, as illustrated in FIG. 5. This enables local or linear pressure points to be avoided.

In this respect, it is naturally also possible to position a plurality of such support means 21 and support elements 22 inside the recess 14, in which case they will be spaced apart from one another in the longitudinal direction of the gliding device 1.

By preference, the recess 14 is as fully covered as possible by the outer top layer 8. In particular, the top layer 8 preferably extends in a single piece from the top face 7 down into the recess 14 and thus forms its longitudinal side walls 27, 28 and the base 18, as illustrated in the diagrams shown in FIGS. 2 to 5, for example. With regard to this covering of the recess 14 over as full a surface as possible and advantageously without any interruptions, it is of practical advantage if the recess 14 has a wedge-shaped cross-section and is designed with appropriate transition radii between the top face 7 and the longitudinal side walls 27, 28 and between the longitudinal side walls 27, 28 and the base 18 of the recess 14. This affords a simple and reliable way of preventing moisture from penetrating the interior of the gliding device structure and causing damage or causing the layers of the gliding device 1 to come apart. In particular, the top layer 8 is also pulled down into the recesses 14 during production of the board-type gliding device 1 and secured at the boundary surfaces of the groove-type indentation, in particular permanently adhered thereto.

Naturally, it would also be possible to provide a top layer 8 made up of several part-pieces, in order to cover the recess 14 and the top face 7 of the gliding device 1 in this manner across as full a surface as possible and protect the gliding device or ski structure from external influences. A top layer 8 made up of several part-pieces in this manner can also be better adapted to the respective loads prevailing in the recessed portion, i.e. in the part-portions around the recess 14 and in the recess 14. In particular, the top layer 8 may have a higher pressure resistance or impact strength in the region of the recess 14 than in the portions lying around the recess 14. Furthermore, using a top layer 8 made up of several parts whereby the adjoining top layer parts overlap slightly offers advantages in terms of production. However, the individual top layer parts may also be disposed abutting with one another or aligned with one another.

Figure 6:
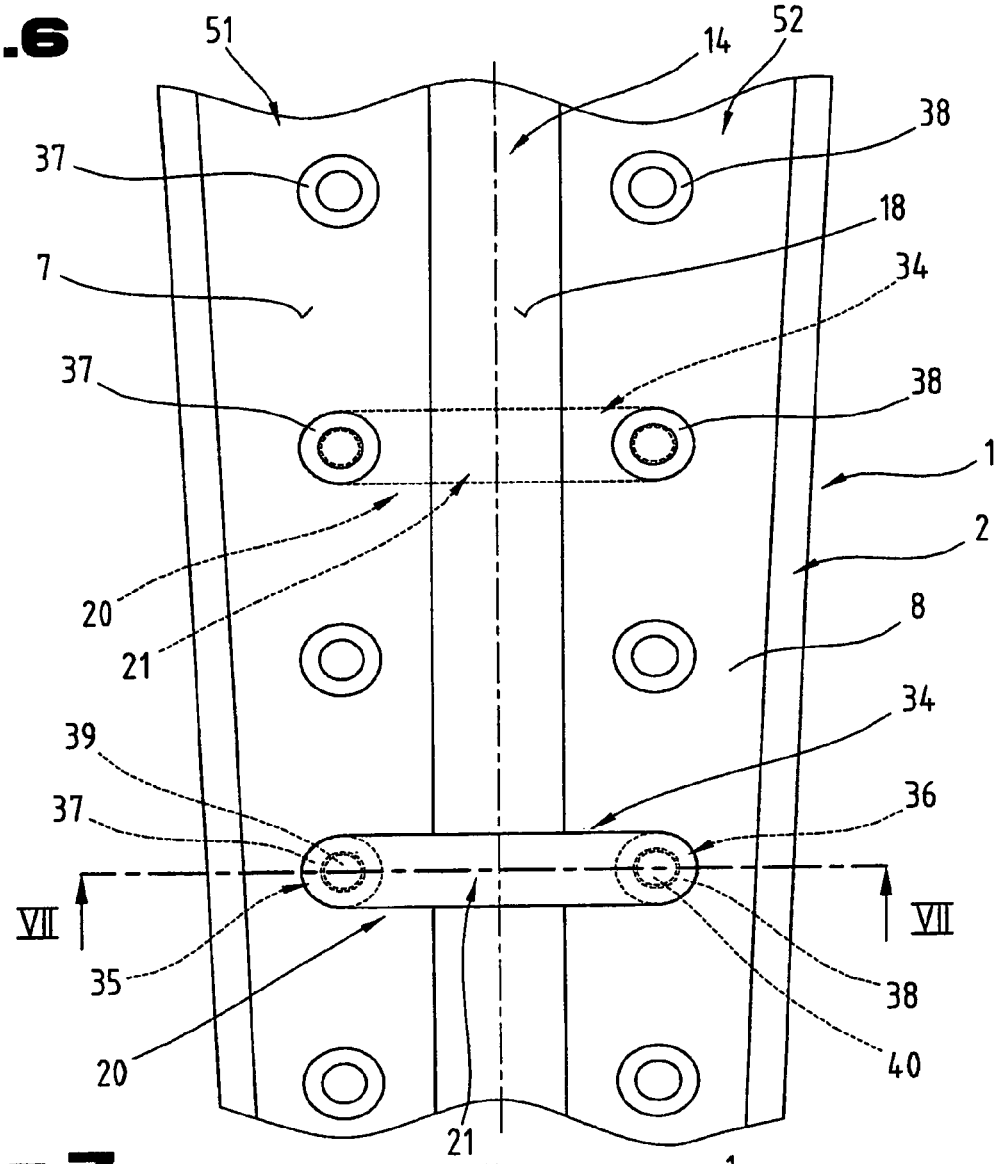
FIG. 6 is a plan view of a longitudinal portion of a ski with a different embodiment of an adjusting means for influencing its cross-sectional geometry.
Figure 7:
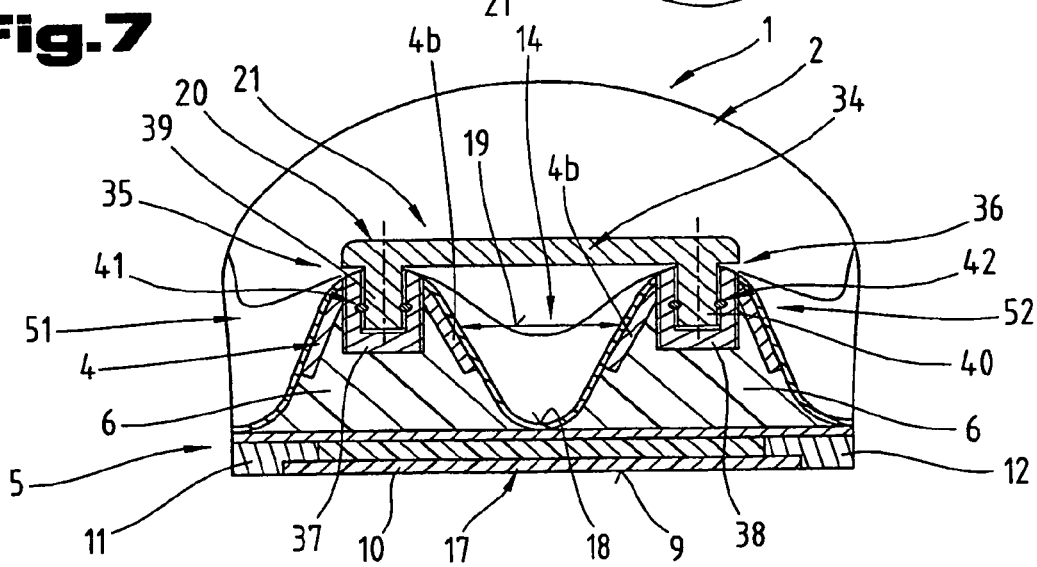
FIG. 7 shows the ski illustrated in FIG. 6, in section along line VII-VII indicated in FIG. 6.

FIGS. 6 and 7 illustrate another embodiment for individually influencing or manually adjusting the transverse stiffness or contour of a board-type gliding device 1, in particular a ski 2. The same reference numbers are used to denote elements or portions already described above and the descriptions of them given above apply to the same parts bearing the same reference numbers.

Here too, the board-type gliding device 1 has at least one recess 14 in the top face 7 extending along the longitudinal mid-axis or close to the longitudinal mid-axis, which weakens the cross-section. The adjusting means 20 for influencing the transverse stiffness and hence the cross-sectional geometry or contour of the gliding device 1 in this instance has a bridge-type support means 21. This support means 21 extends transversely across the recess 14 and connects the portion of the gliding device 1 lying to the left of the recess 14 with the portion of the gliding device 1 lying to the right of the recess 14 in its active position illustrated in FIGS. 6 and 7. This bridge-type support means 21 therefore also assumes the function of a mechanical connecting element 34 between the portions of the gliding device 1 lying on either side of the recess 14.

A mechanical connection between the bridge-type support means 21 or connecting element 34 and the gliding device 1 is formed by positively acting coupling mechanisms 35, 36. By preference, a plurality of coupling mechanisms 35, 36 is provided, to enable the at least one bridge-type support means 21 to be positioned and secured selectively at one of several positions mutually spaced apart from one another in the longitudinal direction of the gliding device 1, as is the case with the embodiment illustrated by way of example in FIG. 6 and indicated by broken lines. A first group of coupling mechanisms 35 co-operates with the left-hand portion of the gliding device 1 and a second group of selectively usable coupling mechanisms 36 co-operate with the right-hand portion of the gliding device 1.

The coupling mechanisms 35, 36 illustrated are provided in the form of positively acting coupling connections. In particular, a plurality of bush-type coupling elements 37, 38 is disposed in the top face 7 of the gliding device 1. These bush-type coupling elements 37, 38 extend from the top face of the gliding device 1 in the direction towards the running surface facing 10 and may be of a hollow cylindrical design in order to provide blind bore-type recesses or a type of bore in the top face 7. These bush-type coupling elements 37, 38 are distributed in a geometrical pattern and are accessible from the top face 7 of the gliding device 1. The positive coupling mechanisms 35, 36 further comprise pin-type coupling elements 39, 40, which match the bush-type coupling elements 37, 38, i.e. which can be moved into a positive engagement with the bush-type coupling elements 37, 38. These pin-type coupling elements 39, 40 are disposed in the end portions, in particular in the mutually opposite end portions of the support means 21. As viewed from the side or in the diagram shown in section in FIG. 7, the support means 21 and the co-operating bridge-type connecting element 34 is shown with the pin-type coupling elements 39, 40 formed thereon in an essentially U or C shape, as may best be seen from FIG. 7.

The coupling mechanisms 35, 36 may preferably also incorporate catch or lock mechanisms 41, 42 in order to hold and secure the support means 21 in its active position illustrated by way of example in FIGS. 6, 7, thereby reliably preventing any undesired twisting or deactivation of the support means 21. These catch or lock mechanisms 41, 42 may be any means known from the prior art. For example, it would be possible to use resilient catch elements—as schematically illustrated—or alternatively screwed or positively acting locking mechanisms, for example based on a pawl.

The bush-type coupling elements 37, 38 may be formed by what might be termed inserts—as illustrated in FIG. 7—which are anchored in the gliding device structure. Due to the fact that a number of bush-type coupling elements 37, 38 are provided in the gliding device structure, an individually selectable connection can be established between the bridge-type support means 21, i.e. between the connecting element 34 and the gliding device 1, at one of several positions disposed at a distance apart from one another in the longitudinal direction of the gliding device 1, as may be seen in particular from FIG. 6. As a result, the supporting or linking action of the support means 21 by reference to the longitudinal direction of the gliding device 1 can be activated in different part-portions, thereby enabling the cross-sectional geometry or the elastic deformability of the gliding device 1 to be influenced and enabling the variability of the gliding device 1 to be changed in terms of its contour. Especially if the support means 21 is disposed relatively close to the binding mounting portion or relatively close to the binding mechanism 3—as in FIG. 1—the elastic deformability of the cross-sectional geometry of the gliding device 1 is relatively high. By contrast, if the bridge-type support means 21 is offset towards the front, in particular positioned in the middle portion of the recess 14 or in the front end portion of the gliding device 1, the deformability of the cross-section of the gliding device 1 is largely prevented or totally prevented, thereby inducing a different type of travel or control behavior of the gliding device 1.

The travel or control behavior can therefore easily be changed by the user of the gliding device 1 and adapted to individual wishes, by selectively activating, in particular positioning, the support means 21 comprising at least one bridge-type connecting element 34 between the first or left-hand top belt strand 4*a* and the second or right-hand top belt strand 4*b*, at one of several possible longitudinal positions of the gliding device 1.

When the support means 21 is in the inactive state, the transverse stiffness of the ski 2 or snowboard is preferably selected so that at least one slight change in its cross-sectional shape can be obtained merely by the hands.

Figure 8:
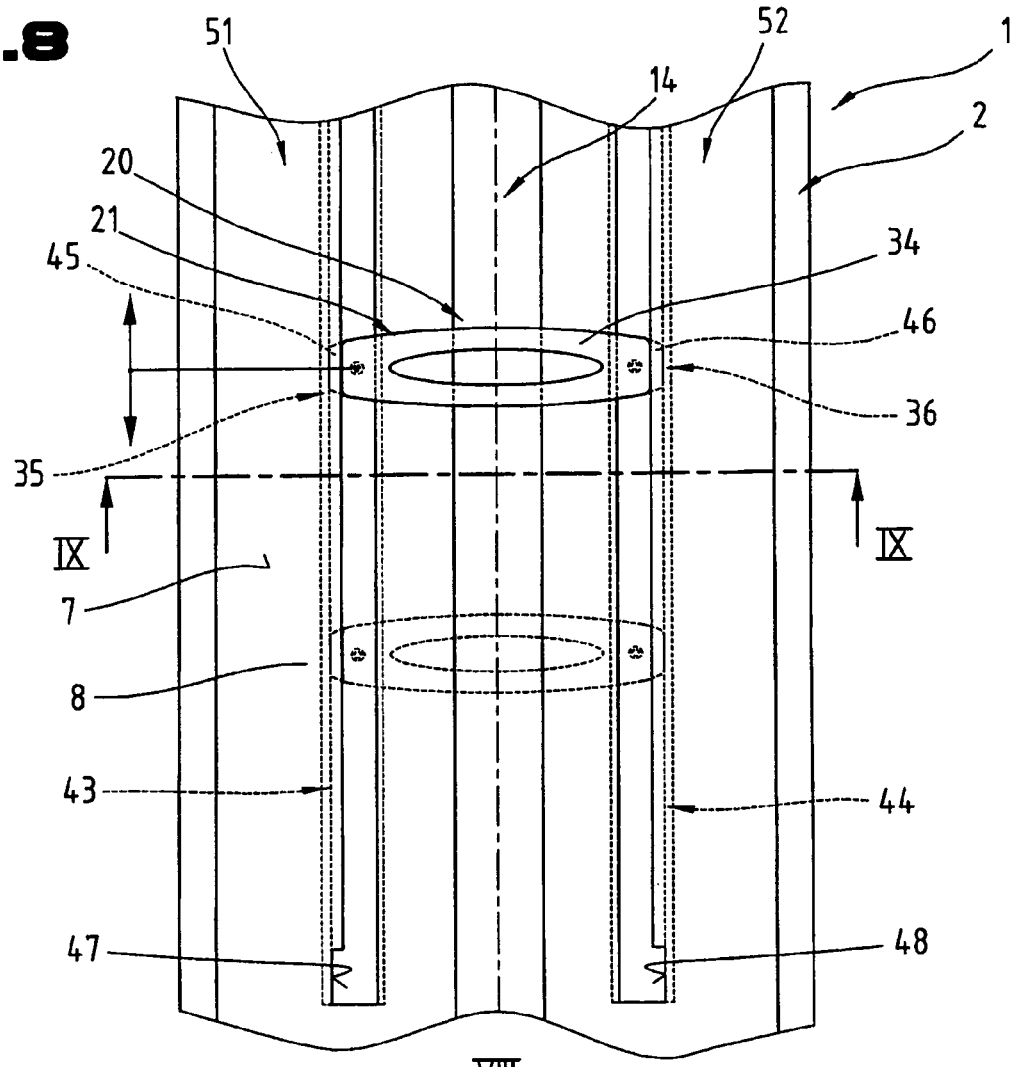
FIG. 8 is a plan view of a longitudinal portion of a ski with a different embodiment of an adjusting means for influencing its cross-sectional geometry.
Figure 9:
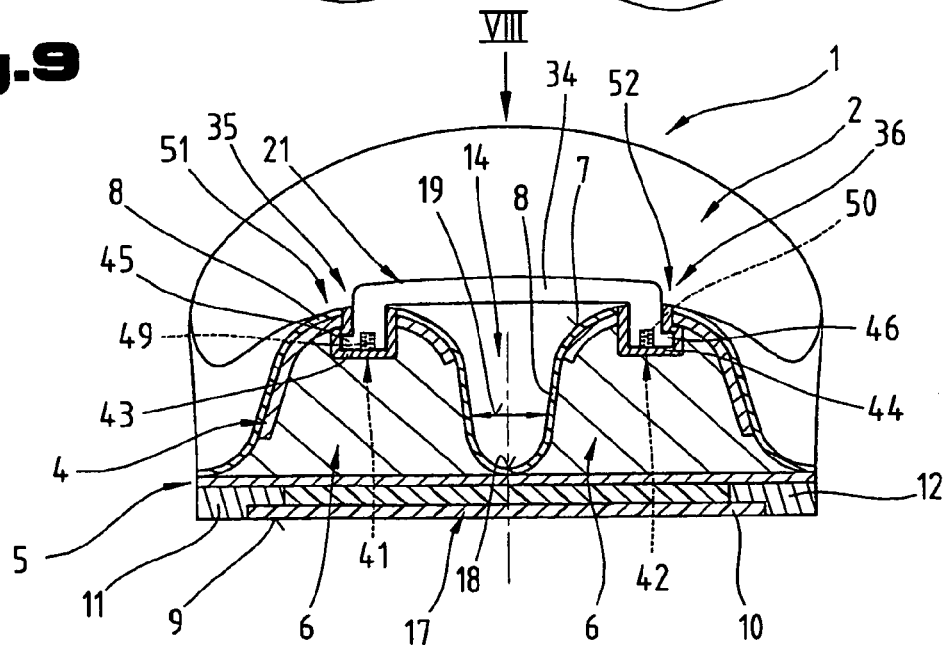
FIG. 9 shows the ski illustrated in FIG. 8, viewed in section along line IX-IX indicated in FIG. 8.

FIGS. 8, 9 illustrate another example of an embodiment of a gliding device 1 with a bridge-type support means 21 or connecting element 34 for individually varying the transverse stiffness of a ski 2 or board-type gliding device 1, this design constituting a modified approach to the embodiment illustrated in FIGS. 6, 7.

In this case, the positively acting coupling mechanism 35, 36 between the support means 21 and the top face 7 of the left-hand and right-hand portions of the gliding device 1 have at least one guide element 43, 44 extending in the longitudinal direction of the gliding device 1 for the support means 21 and its connecting element 34. By preference, the gliding device portion lying to the left of the recess and to the right of the recess are each provided with a track-type guide element 43, 44. These guide elements 43, 44 are preferably integrated in the gliding device structure and are recessed with respect to the top face 7, as may be seen in particular from FIG. 9, for example. Another option, however, would be to provide track-type guide elements 43, 44 but which are raised relative to the top face 7, in particular secured to the top face 7 by means of non-positive and/or positive connecting means.

In cross-section, the track or section-type guide elements 43, 44 are designed so that a positive connection can be established between the side portions of the gliding device 1 and the oppositely lying end portions of the bridge-type connecting element 34 but which is variably displaceable in the longitudinal direction with respect to the gliding device 1. In particular, the guide elements 43, 44 have at least one undercut, which can be moved into a positive engagement with a co-operating projection 45, 46 on the connecting element 34. Naturally, it would also be possible to opt for an embodiment which is structurally the reverse in terms of the undercuts and projections 45, 46.

In this respect, the essential factor is that the bridge-type connecting element 34 can be positioned anywhere along the guide elements 43, 44. In particular, the bridge-type connecting element 34 can be positioned steplessly within the longitudinal extension of the guide elements 43, 44. It is also of advantage if the bridge-type connecting element 34 does not have to be removed from the gliding device 1 in order to be able to position it in a different position relative to the longitudinal extension. This simultaneously offers a reliable way of ensuring that it is not lost or misplaced. To enable the bridge-type connecting element 34 to be removed from the gliding device 1 if necessary and to enable it to be coupled with the gliding device 1, at least one free space 47, 48 is provided on the guide elements 43, 44. Due to this free space 47, 48, it is also possible to provide several bridge-type support means 21 on the gliding device 1 or replace an existing support means 21 by a support means with different properties, in particular different types of strength properties.

A catch or lock mechanism 41, 42 may also be provided in order to prevent the connecting element 34 from undesirably sliding or inadvertently moving along the guide elements 43, 44. In the embodiment illustrated as an example, the catch or lock mechanism 41, 42 comprises at least one spring element 49, 50, which generates a constant biasing action between the guide elements 43, 44 and the bridge-type connecting element 34 or its coupling projections in order to prevent the support means 21 from sliding of its own volition or moving of its own volition. This elastic biasing action is dimensioned so that a manual adjustment of the bridge-type connecting element 34 can still be made manually along the guide elements 43, 44 without any difficulty.

In the embodiment illustrated in FIGS. 6 to 9, the recess 14 is disposed between more or less part-cylindrical raised regions or cambers 51, 52 extending across the major part, i.e. more than 50%, of the length of the gliding device 1. By preference, two adjacently lying cambers 51, 52 or part-cylindrical beads are provided essentially parallel with one another and extend in the longitudinal direction of the gliding device 1, between which the recess 14 is formed. These two cambers of the top face 7 thus result in a double arch or dome shaped cross-sectional contour with convex mounds, as may be seen from FIG. 9, for example. The top layer 8 preferably extends continuously or integrally in terms of its transverse extension, from the first control edge 11 as far as the oppositely lying, second control edge 12 of the gliding device 1, as may be seen from FIGS. 8 and 9, for example.

Figure 10:
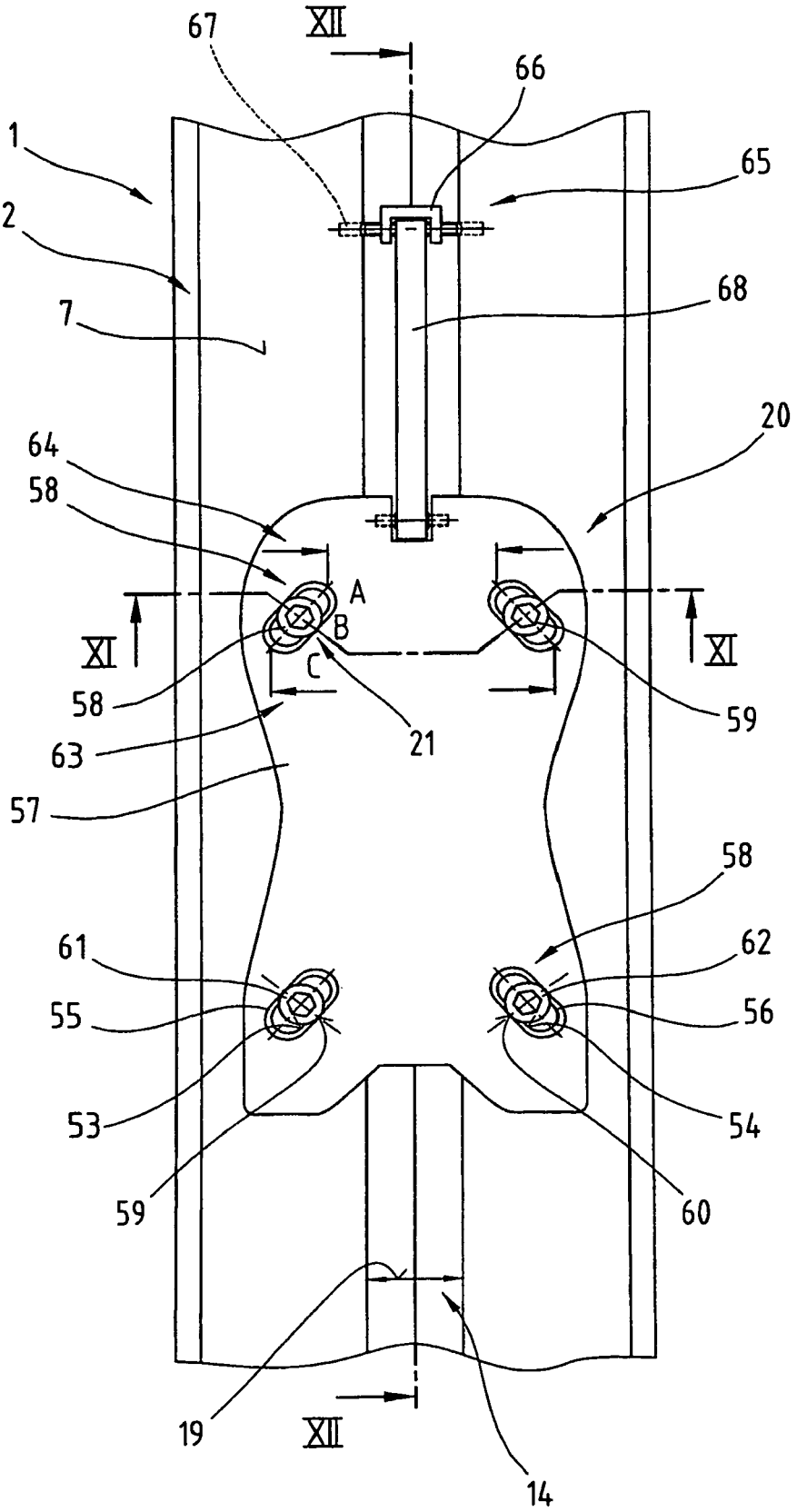
FIG. 10 is a simplified, schematic diagram showing a plan view of a longitudinal portion of a ski or snowboard with a different embodiment of an adjusting means for variously influencing the cross-sectional geometry of the corresponding gliding device.
Figure 12:
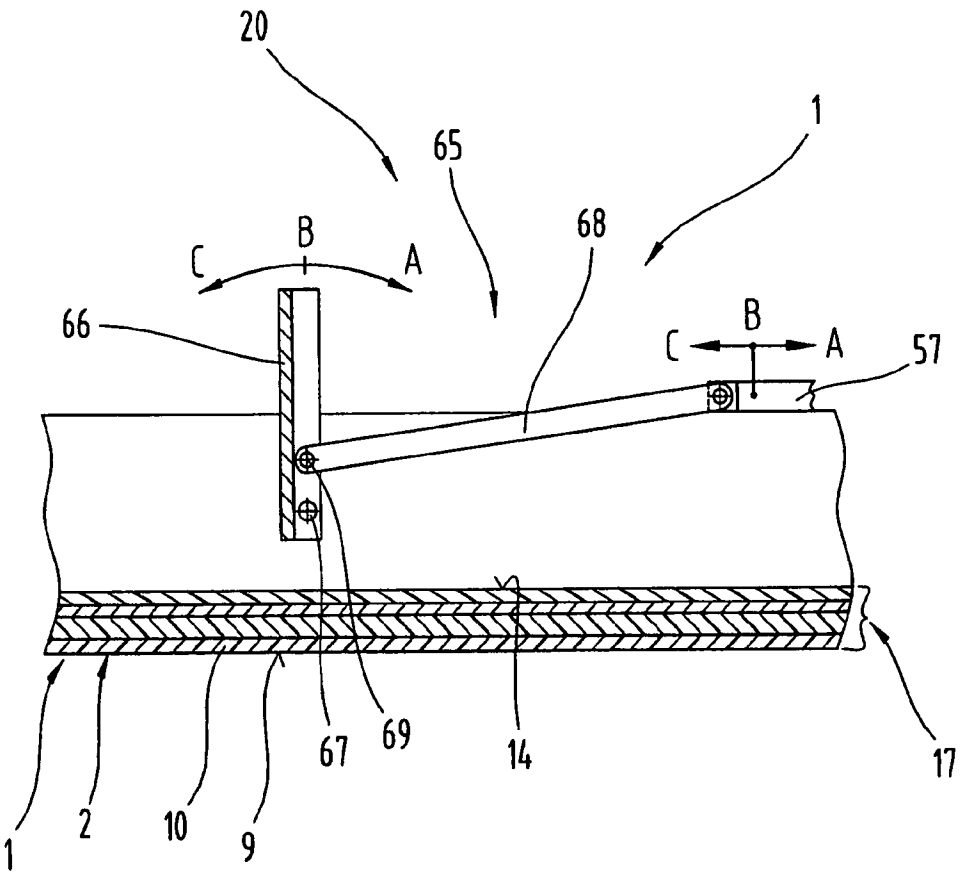
FIG. 12 shows the gliding device illustrated in FIG. 10, viewed in section along line XII-XII indicated in FIG. 10.
Figure 11:
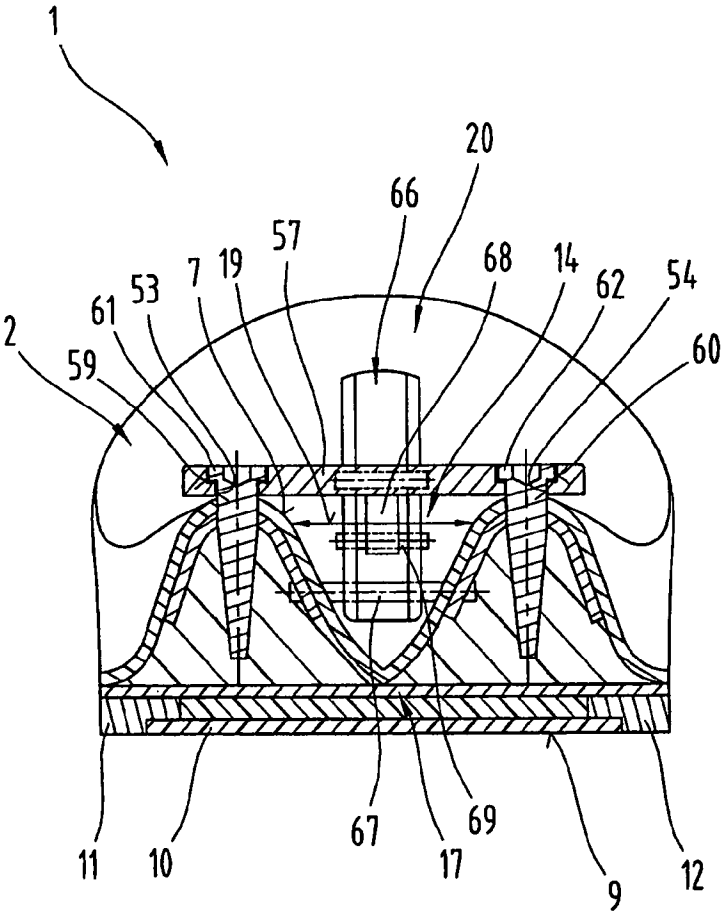
FIG. 11 shows the gliding device illustrated in FIG. 10, viewed in section along line XI-XI indicated in FIG. 10.

FIGS. 10 to 12 illustrate an example of another embodiment of a board-type gliding device 1 in conjunction with technical means for a manually variable, pre-settable cross-sectional geometry or contour, which is often also referred to as "sidecut".

In this instance, the adjusting means 20 is designed so that a width 19 of the recess can be varied to a certain degree in accordance with the user's wishes. Accordingly, this adjusting means 20 has support or guide surfaces 53, 54 which, by reference to plane extending essentially parallel with the running surface facing 10, extend obliquely or at an angle with respect to the longitudinal axis of the gliding device 1. By preference, these support or guide surfaces 53, 54 are disposed in pairs and, by reference to the recess 14, first support or guide surfaces 53 co-operate with the left-hand gliding device portion and second support or guide surfaces 54 co-operate with the right-hand gliding device portion.

Disposed in pairs, the support or guide surfaces 53, 54 extend in a wedge shape or at an angle with respect to one another by reference to an essentially horizontal plane and to the longitudinal extension of the gliding device 1, as may best be seen from FIG. 10. In particular, the support or guide surfaces 53, 54 are oriented with respect to one another so as to cause a linear relative movement between the adjusting means 20 and the top face 7 of the gliding device 1 in the longitudinal direction with respect to the gliding device 1 due to the oblique disposition of the support or guide surfaces 53, 54 and at the same time a relative movement in the transverse direction with respect to the gliding device 1.

The support or guide surfaces 53, 54 are preferably provided in the form of elongate orifices of the recesses 55, 56, the longitudinal mid-axes of which extend obliquely or at an angle with respect to the longitudinal mid-axis of the gliding device 1—by reference to a plane oriented essentially parallel with the running surface facing 10, as may best be seen from FIG. 10. The elongate recesses 55, 56 forming the above-mentioned support or guide surfaces 53, 54 at the lateral or peripheral boundary surfaces are disposed in a slide element 57, which may be of a plate-type design, for example. A plurality of recesses 55, 56 or corresponding orifices is preferably provided inside such a slide element 57, forming a plurality of support or guide surfaces 53, 54 disposed in pairs and spaced apart from one another in the longitudinal direction of the gliding device 1. At least two pairs of angled support or guide surfaces 53, 54 oriented at an angle with respect to one another in the longitudinal direction of the gliding device 1 are provided on the slide element 57. The slide element 57 is mounted so that it can be displaced in the longitudinal direction of the gliding device 1 when appropriate adjusting or sliding forces are applied within a plane extending essentially parallel with the running surface facing 10. In order to guide the slide element 57 adequately within this plane and in the longitudinal direction of the gliding device 1, at least one guide mechanism 58 is provided. This guide mechanism 58 between the slide element 57 and the gliding device 1 ensures that the slide element 57 can be pushed relative to the gliding device 1 in its longitudinal direction within said plane. In particular, the at least one guide mechanism 58 prevents any tendencies towards a lifting movement of the slide element 57 relative to the top face 7 as well as lateral deviating movements in the transverse direction with respect to the gliding device 1.

The support or guide surfaces 53, 54 of the slide element 57 each co-operate with a thrust surface 59, 60 on the top face 7 of the gliding device 1. These thrust surfaces 59, 60 may easily be provided in the form of the head and/or the shaft of screws anchored in the gliding device structure, which stand proud of the top face 7, as may best be seen from the diagram illustrated as an example in FIG. 11.

Alternatively or in combination, the thrust surfaces 59, 60 may also be provided by the boundary surfaces of shaped regions of the top face 7, in particular by the lateral boundary walls of the groove-type recess 14, so that the support or guide surfaces 53, 54 on the slide element 57 co-operate directly with the top face 7 or the recess 14 of the board-type gliding device 1 provided in the form of a ski 2. These thrust surfaces 59, 60 co-operating with the gliding device 1 may be provided in the form of projections on the top face 7 and/or by the recess 14 in the top face 7 of the gliding device 1. By preference, the thrust surfaces 59, 60 are provided in the form of projections 61, 62 fixedly or rigidly joined to the board-type gliding device 1, which stand proud of the top face 7 of the gliding device 1, since this enables an appropriate levering action to be produced, whereby a relatively high adjusting or deforming force acts on the cross-section of the gliding device 1. In the embodiment illustrated as an example in FIGS. 10 to 12, these projections 61, 62 are provided in the form of screw heads which define the thrust surfaces 59, 60 for the slide element 57 in their peripheral portions.

Due to the positive co-operation of the support or guide surfaces 53, 54 on the slide element 57, which are nevertheless able to slide relative to one another, with the ski-side thrust surfaces 59, 60, a pulling force or pushing force occurs which also extends transversely to the longitudinal axis of the gliding device when the slide element 57 is actively moved along the longitudinal axis of the gliding device 1, which can cause a deformation in the cross-section of the gliding device 1. Whether a transversely extending pulling force or pushing force occurs between the left-hand and right-hand ski or gliding device portions will depend on the direction of displacement between the adjusting means 20 or its slide element 21 and the gliding device 1. In particular, a displacement of the slide element 57 causes an elastic deformation of the gliding device 1 in its deformation portion 17.

When the adjusting means 20 (position B) is in the inactive position primarily illustrated in FIG. 10, the running surface facing 10 is essentially flat or planar by reference to its cross-sectional contour. In a first active position (position A) of the slide element 57 relative to the gliding device 1 or its thrust surfaces 59, 60, the projections 61, 62 are forced apart from one another and the slide element 57 has a tendency to increase the width 19 of the recess 14. Consequently, the running surface facing 10 assumes a concave cross-sectional shape by reference to the gliding device 1 because the control edges 11, 12 are forced downwards relative to the middle portion. In another or second active position (position C) of the adjusting means 20, in particular of the slide element 57, the projections 61, 62 are moved inwards, i.e. in the direction towards the recess 14, so that the width 19 of the recess 14 becomes narrower. Consequently, the running surface facing 10 assumes an outwardly cambered or convex cross-sectional shape. In particular, the control edges 11, 12 are lifted slightly relative to the middle portion of the running surface facing 10. As a result, the adjusting means 20 is designed to vary the cross-sectional geometry of the gliding device 1 so that either a neutral or flat running or gliding surface (position B) is set, or a convex running or gliding surface (position A) or a concave running or gliding surface (position C) at the running surface facing 10 by reference to the cross-section of the gliding device 1.

A number of projections 61, 62 and co-operating elongate recesses 55, 56 may be disposed in pairs by reference to the longitudinal direction of the gliding device 1 in order to produce a robust adjusting means 20 and cause a cross-sectional deformation of the gliding device 1 across sufficiently wide longitudinal portions of the gliding device 1.

Naturally, it would also be possible to opt for an inverse arrangement with respect to the projections 61, 62 and co-operating recesses 55, 56. In particular, at least two projections 61, 62 may be provided on the bottom face of the slide element 57, which co-operate with recesses 55, 56 in the top face 7 of the gliding device 1. In particular, such recesses 55, 56 may extend in a herringbone pattern in the top face 7 and form the appropriately angled support or guide surfaces 53, 54. It would naturally also be possible to orient the projections 61, 62 and the co-operating recesses 55, 56 obliquely with respect to the longitudinal mid-axis of the gliding device 1.

The embodiment illustrated in FIGS. 10 to 12 therefore constitutes an adjusting means 20 comprising a prizing means 63 for individually widening the width 19 of the recess 14 to the desired degree as required and a pulling means 64 for individually reducing the width 19 of the recess 14 as required. The prizing means 63 and the pulling means 64 of the adjusting means 20 are based on a co-operation between the preferably plate-type slide element 57 and the top face 7 of the gliding device 1.

This design and the embodiments still to be described below therefore have individually adjustable adjusting means 20, and at least one prizing means 63 and a pulling means 64 are structurally combined or provided in one. This keeps production costs and overall costs of the gliding device 1 to a minimum, even though the end user is provided with an increased number of functions. Structurally combining a prizing means and pulling means 63, 64 also makes it easier to use and handle the resultant adjusting means 20 and gliding device 1.

The adjusting means 20 preferably also has at least one lever or gear arrangement 65, in order to produce a forceful or force-enhanced transfer of the adjusting means 20 and its slide element 57, in particular the prizing means 63 and the pulling means 64, from the neutral or inactive position (position B) into at least one active position (position A, C). In the embodiment illustrated as an example in FIGS. 10 and 11, the lever or gear arrangement 65 has at least one pivot lever 66, which can be operated by the user of the gliding device 1 or skier as and when necessary. This pivot lever 66 is mounted so that it can pivot about an axis 67 extending essentially transversely to the longitudinal axis of the gliding device 1 and essentially parallel with the running surface facing 10. Disposed between this pivot lever 66 and the slide element 57 is at least one motion transmitting arm 68, which converts a pivoting movement of the pivot lever 66 into a linear displacement of the slide element 57 along the longitudinal axis of the gliding device 1. In particular, depending on the direction in which the pivot lever 65 is pivoted, either a pulling movement or a pushing or prizing movement is generated between the left-hand and right-hand portions of the gliding device 1. As it pivots, the manually operable pivot lever 66 is connected via a linking pin 69 extending parallel with the axis 67 to the motion transmitting arm 68. In the oppositely lying end portion, the motion transmitting arm 68 is articulatingly connected to the slide element 57, as schematically indicated in FIGS. 10 to 12.

In this respect, the pivot lever 66 can be telescopically designed so that it can be lengthened or shortened or deflected or folded open and shut to enable an adequate levering action to be produced on the one hand and to afford a compact disposition saving as much space as possible on the top face 7 of the gliding device 1 on the other hand. The pivot lever 66 of the lever or gear arrangement 65 is preferably disposed at least partially inside the recess 14. In particular, the pivot lever 66 lies predominantly, i.e. with more than 50% of its length, inside the recess 14 when the gliding device 1 is in a state ready to be deployed. The transmission of a pulling or pushing movement to the slide element 57 relative to the longitudinal direction of the gliding device 1 is therefore easily obtained by a pivoting movement of the pivot lever 66 in the direction towards the front or rear end of the gliding device 1.

Figure 13:
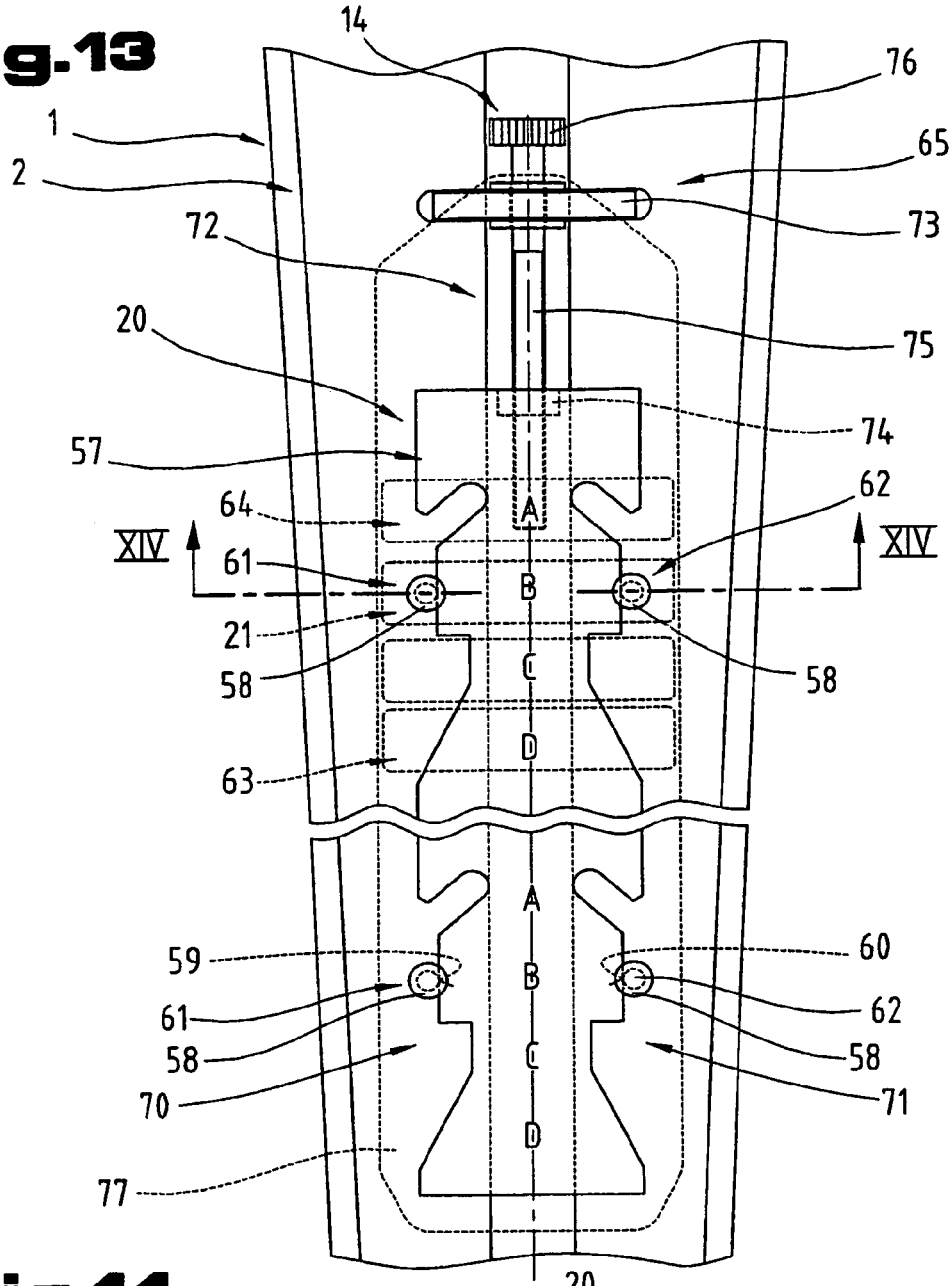
FIG. 13 is a simplified, schematic diagram showing a plan view of a longitudinal portion of a ski or snowboard with a different embodiment of an adjusting means for variously influencing the cross-sectional geometry of the corresponding gliding device.
Figure 14:
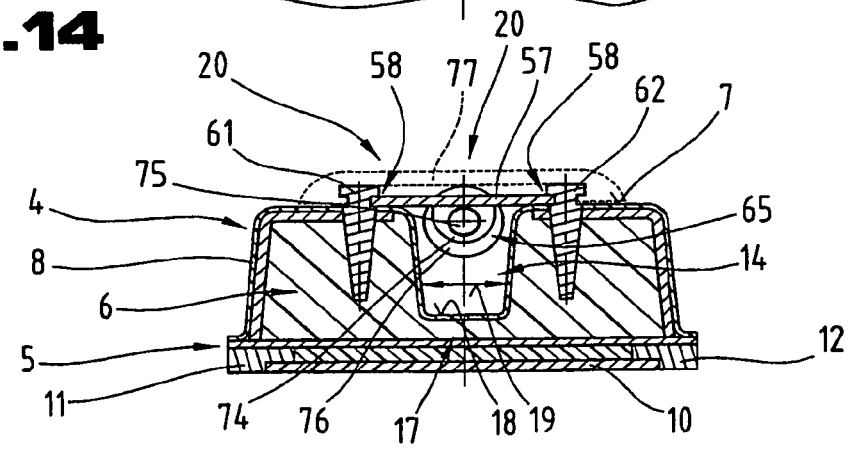
FIG. 14 shows the gliding device illustrated in FIG. 13, viewed in section along line XIV-XIV indicated in FIG. 13.

FIGS. 13, 14 illustrate another embodiment of the adjusting means 20. In this instance, at least one slide element 57 is provided on the top face 7 of the gliding device 1, which is able to operate as a prizing means 63, a pulling means 64 and also as a support means 21. In particular, by reference to the longitudinally extending recess 14 of the gliding device 1, this adjusting means 20 is able to operate selectively as a support means 21 (position B), as a pulling means 64 (position A) and as a prizing means 63 (position D) between the left-hand and right-hand portions of the gliding device 1 and can also assume an inactive position (position C) in which the adjusting means 20 is inactive and it is exclusively the intrinsic deformation properties of the gliding device 1, in particular the ski 2, which are active.

To this end, the slide element 57 has slide tracks 70, 71 in its side edge portions, which extend so that they act on thrust surfaces 59, 60 on the top face 7 of the gliding device 1 in such a way that, by reference to the recess 14 extending longitudinally down the center, they either afford a supporting action (position B), or produce a pushing-together action (position A), or a prizing apart action (position D) between the left-hand and right-hand portions of the gliding device 1. In addition, this adjusting means 20 and its slide element 57 have an inactive position (position C) in which the action of the adjusting means 20 is switched off and the intrinsic or inherent transverse stiffness or cross-sectional geometry of the gliding device structure is unaffected by the adjusting means 20. In this inactive position (position C), the thrust surfaces 59, 60 on the gliding device and the slide tracks 70, 71 on the slide element 57 are spaced at a distance apart from one another by reference to the transverse direction of the gliding device 1. In particular, in this inactive position (position C), the transverse stiffness of the gliding device 1 is primarily defined by the strength or elasticity properties of the elastic deformation portions 17. In the embodiment illustrated as an example in FIG. 13, the slide tracks 70, 71 on the slide element 57 may extend in a stepped arrangement. However, stepless transitions could also be provided between the respective adjustment positions A-D to produce stepless changes between the inactive and active positions indicated by positions A-D.

In the embodiment illustrated as an example, the thrust surfaces 59, 60 are disposed on projections 61, 62, which are rigidly or fixedly joined to the gliding device 1. In particular, these projections 61, 62 project above the top face 7 or above the top layer 8. In the embodiment illustrated as an example, these projections 61, 62 are provided in the form of heads of screw elements. The heads of these screw elements simultaneously have at least one projection or a groove or a retaining flange, which forms the guide mechanism 58 for the slide element 57 in the longitudinal direction with respect to the gliding device 1. In the embodiment illustrated as an example, the guide mechanism 58 has a groove in the projections 61, 62, by means of which the plate-type slide element 57 is guided in the longitudinal direction with respect to the ski 2 or gliding device 1 so that lifting movements relative to the top face 7 and deviating movements transversely to the longitudinal direction of the gliding device 1 are prevented.

The adjusting means 20 in this instance also has a lever or gear arrangement 65 for increasing the force used to switch the slide element 57 from the inactive position (position C) into at least one of its active positions (position A, B or D). To this end, the lever or gear arrangement 65 comprises a threaded spindle arrangement 72, by means of which the slide element 57 is pushed into the respective position A, B, C or D relative to the longitudinal direction of the gliding device 1 and relative to its thrust surfaces 59, 60 and can be retained at the desired relative position and positioned so that it can not move. The threaded spindle arrangement 72 has a rotary bearing 73 and at least one threaded bush 74, which is preferably attached to or affixed to the slide element 57. A threaded spindle 75 of the threaded spindle arrangement 72 extends at least between the threaded bush 74 and the rotary bearing 73 for the threaded spindle 75. The length of the threaded spindle 75 is at least dimensioned so that the slide element 57 can be moved into the respective adjustment positions A-D. The rotary bearing 73 for the threaded spindle 75 may be provided in the form of a bearing block extending transversely to the groove-type recess 14, which is integrated in the gliding device structure or is positively inserted in the gliding device structure.

A simple operating element 76 may be provided for manipulating operation of the threaded spindle arrangement 72, for example a knurled wheel, an operating lever, a ratchet mechanism, a coupling mechanism for coupling with an electrically operated tool or similar as and when necessary. It is preferable if the lever or gear arrangement 65, in particular the threaded spindle arrangement 72, can be operated without tools, as was the case with the lever or gear arrangements 65 described above. Alternatively or in combination, a positive coupling mechanism, may be provided, for example a cruciform or flat slot, by means of which the adjusting means 20 can be moved using tools, for example a screwdriver or screwing device driven by electric motor.

At least some portions of the adjusting means 20, in particular the slide element 57, may be covered or faced with at least one facing element 77, as schematically indicated by broken lines. This hood or cover-type facing element 77 preferably covers sharp-edged portions of the adjusting means 20, significantly reducing any risk of injury. This facing element 77 may be positively snap-fitted over the adjusting means 20 at least in part-portions, in which case the projections 61, 62 on the ski 2 or gliding device 1 may also be snap-fit projections, as may be seen in particular from the diagram illustrated in FIG. 14. Only the operating element 76 of the lever or gear arrangement 65, which is an operating wheel in the embodiment illustrated as an example, is not covered by the facing element 77, which means that it can be readily accessed and the respectively desired individual setting can be made at any time without any problem.

Figure 15:
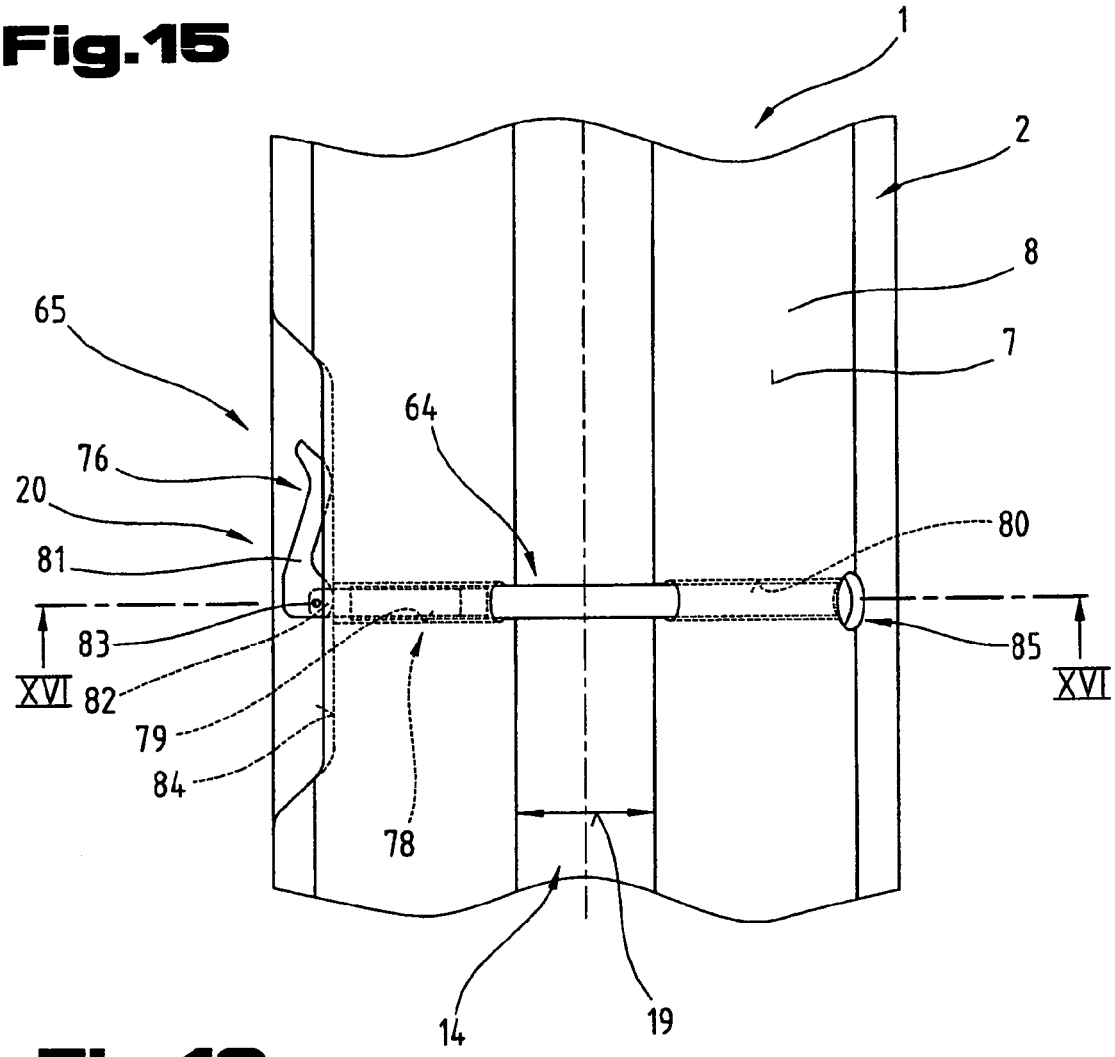
FIG. 15 is a plan view of a longitudinal portion of a ski with a different embodiment of an adjusting means for influencing the cross-sectional geometry of the ski.
Figure 16:
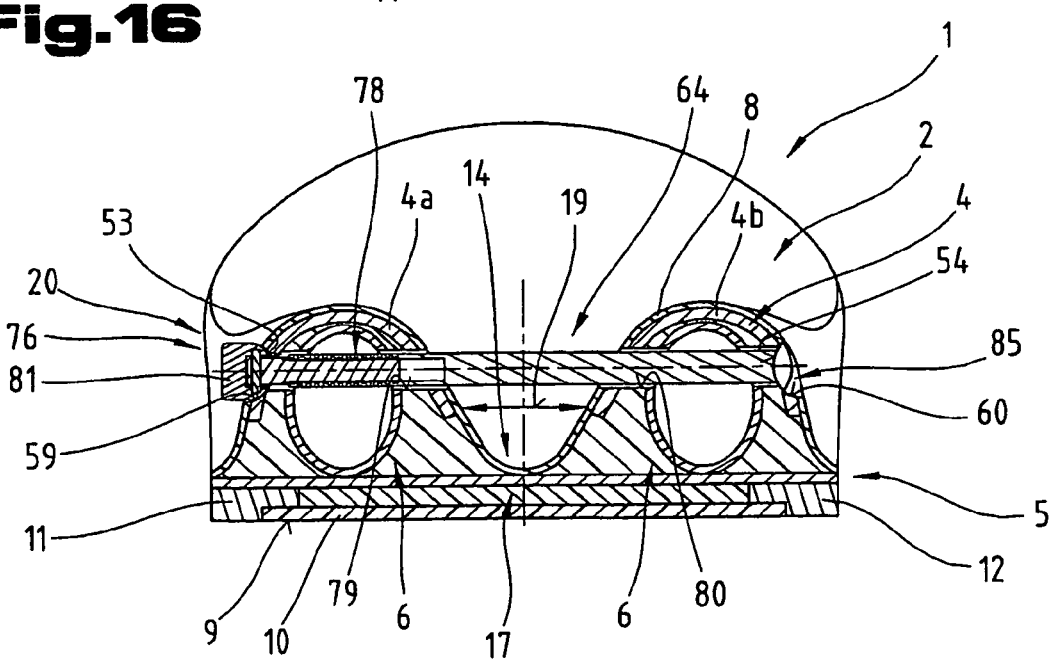
FIG. 16 shows the ski illustrated in FIG. 15, viewed in section along line XVI-XVI indicated in FIG. 15.

FIGS. 15, 16 illustrate an example of another embodiment of a board-type gliding device 1 which can be modified in terms of its cross-sectional shape, in particular in the form of a ski 2.

In this instance, the adjusting means 20 for influencing the cross-sectional shape of the gliding device 1 is provided in the form of a pulling means 64 between the left-hand and the right-hand portions of the gliding device 1. This pulling means 64 comprises a threaded spindle arrangement 78, which extends transversely to the longitudinal extension of the recess 14 and essentially parallel with the gliding or running surface on the bottom face 9 of the running surface facing 10. In the embodiment illustrated as an example, at least one transverse bore 79, 80 is provided, which preferably extends across a predominant part-portion of the width of the gliding device 1 in this cross-sectional portion. The transverse bores 79, 80 may extend slightly conically or taper to allow sufficient degrees of freedom for an elastic deformation of the gliding device 1 within its deformation portion 17.

The thrust surfaces 59, 60 on the gliding device are disposed in the region of the side faces, i.e. in the side wall portions of the board-type gliding device 1. The support or guide surfaces 53, 54 are disposed in the distal end portions of the threaded spindle arrangement 78. In the embodiment illustrated as an example, the transverse bores 79, 80 are designed so that they constitute continuous bores which extend into the recess 14. The threaded spindle arrangement 78 extends in the manner of a feed shaft between the lateral thrust surfaces 59, 60 of the gliding device 1 and thus extends transversely to the longitudinal direction of the recess 14, and the middle portion of the threaded spindle arrangement 78 lies inside the recess 14. In other words, the threaded spindle arrangement 78 extends deeper or is disposed lower than the uppermost apex points of the partially cylindrical cambers 51, 52 of the top face 7 of the ski 2 or gliding device 1.

The lever or gear arrangement 65 for operating the adjusting means 20 with additional force, in particular the threaded spindle arrangement 78, is provided in the form of a folding lever 81 in this instance. The purpose of this folding lever 81 is to operate the threaded spindle arrangement 78 with additional force so that a higher torque can be applied and the user is able to operate the adjusting means 20 with as little effort as possible and set it according to his wishes. Especially if the folding lever 81 is oriented as far as possible transversely to the longitudinal axis of the threaded spindle arrangement 78, a higher torque can be applied to the pulling means 64, in particular to the threaded spindle arrangement 78, in order to produce a stronger pulling action, causing the running surface facing 10 to camber as a result.

The folding lever 81 may additionally have an eccentric cam 82, by means of which the biasing action of the pulling means 64 or the biasing action of the threaded spindle arrangement 78 can be increased or reduced simply by pivoting the folding lever 81. The folding lever 81 is mounted on a terminal end of the threaded spindle arrangement 78 by means of a pivot shaft 83 extending transversely to the longitudinal extension of the threaded spindle arrangement 77 so that it can be folded out and in.

At least the folding lever 81 or some other operating element 76 is preferably provided inside a lateral indentation 84 of the gliding device 1 so that the operating element 76 is able to assume a position in which it does not project or does not project significantly beyond the side control edges 11, 12, as may best be seen from FIG. 15. The end of the threaded spindle arrangement 78 lying opposite the operating element 76 is preferably also at least partially accommodated in an indentation 85 in the oppositely lying side wall of the ski 2 or gliding device 1.

If the mutually opposite end portions of the threaded spindle arrangement 78 are joined to the respective gliding device portions to the left and right of the recess 14 so that they are unable to slide, the threaded spindle arrangement 78 may also serve as a prizing means for increasing the width 19 of the recess 14.

Figure 17:
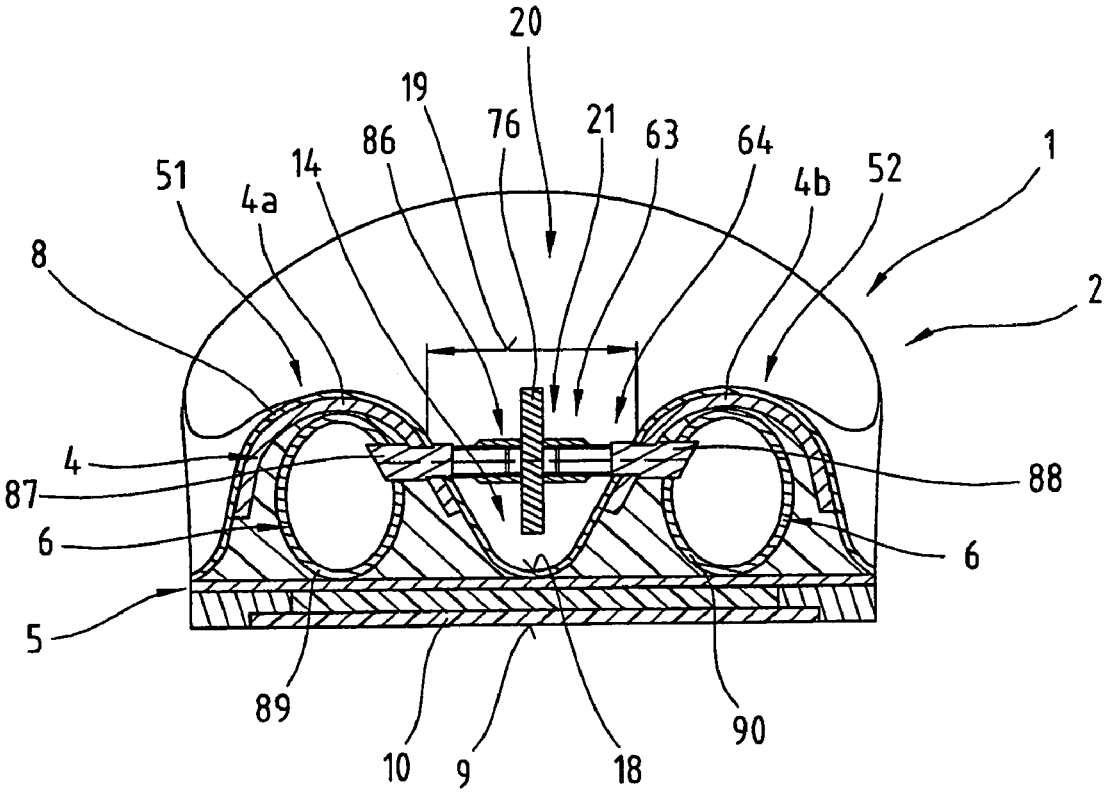
FIG. 17 is a cross-sectional diagram of a ski with a different embodiment of an adjusting means for influencing its cross-sectional geometry.

FIG. 17 illustrates another embodiment of an adjusting means 20, incorporating the functions of a support means 21, prizing means 63 and pulling means 64 for varying the cross-sectional geometry as and when required, in particular the contour, and hence also the travel behavior of a board-type gliding device 1.

In this instance, the adjusting means 20 has a threaded spindle arrangement 86 extending transversely to the longitudinal extension of the gliding device 1, i.e. transversely to the recess 14. End portions of this threaded spindle arrangement 86 lying opposite one another are connected to the gliding device 1 so that they move with it, in which case a first end portion of the threaded spindle arrangement 86 is connected to the left-hand portion and a second end portion of the threaded spindle arrangement 86 is connected to the right-hand portion of the gliding device 1. In particular, the end portions are anchored in bead-shaped cambers 51, 52 of the gliding device 1, for example. To provide an anchoring for the end portions of the threaded spindle arrangement 86 that will not break and in particular can not be torn out, at least one anchoring element 87, 88 may be provided in the core region of the gliding device 1. This at least one anchoring element 87, 88 may be provided in the form of at least one projection, for example at least one screw stub in or on at least one section 89, 90 disposed in the core region of the gliding device 1 or in its core 6. It is of advantage if the sections 89, 90 integrated in the core region are provided in the form of two tubular or elliptical hollow sections co-operating with the two gliding device portions. However, these anchoring elements 87, 88 may also be defined by other types of retaining element integrated in the core 6 of the gliding device structure.

The threaded spindle arrangement 86 disposed transversely to the recess 14 comprises a first spindle portion with a left-hand thread and an oppositely lying second thread portion with a right-hand thread so that a linear lengthening or linear shortening of the effective length of the threaded spindle arrangement 86 is obtained depending on the direction in which the operating elements 76 is rotated. If the operating element 76, which is preferably provided in the form of an operating wheel, is rotated in the direction in which the distal ends of the threaded spindle arrangement 86 move apart from one another, the threaded spindle arrangement 86 serves as a prizing means 63. In other words, the running surface facing 10 is cambered downwards so that the bottom face 9 of the gliding device 1 is concavely cambered. By contrast, rotating the operating element 76 of the threaded spindle arrangement 86 in the other direction will shorten the length of the threaded spindle arrangement 86 and will constitute a pulling means 64 which moves the left-hand and right-hand portions of the gliding device 1 towards one another in the region of the top face 7. This will slightly reduce the width 19 of the recess 14. Consequently, a convexly cambered bottom face 9 can be obtained on the gliding device 1 if the co-operating pulling forces of the pulling means 64 are sufficiently strong or if the operating element 76 has traveled a sufficient angle of rotation and is rotated in the corresponding direction.

The thread pitches of the two spindles of the threaded spindle arrangement 86 are preferably selected so that a sufficiently high pulling and pushing action can be generated and at the same time the respective pulling or pushing position can be secured relative to the gliding device 1 by friction. In the pulling and pushing neutral state of the adjusting means 20 illustrated in FIG. 17, a width 19 of the recess 14 at its top end portion facing away from the base 18 is at least 20 mm to approximately 60 mm, preferably approximately 40 mm.

The embodiments illustrated as examples represent possible design variants of a ski 2 or snowboard and its adjusting means 29 and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that, in order to provide a clearer understanding of the structure of the part-feeding system, it and its constituent parts are illustrated to a certain extent out of scale and/or on an enlarged scale and/or on a reduced scale.

Above all, the individual embodiments of the subject matter illustrated in FIGS. 1, 2, 3; 4, 5; 6, 7; 8, 9; 10, 11, 12; 13, 14; 15, 16; 17 constitute independent solutions proposed by the invention in their own right. The objectives and associated solutions proposed by the invention may be found in the detailed descriptions of these drawings.

LIST OF REFERENCE NUMBERS

1 Gliding device
2 Ski
3 Binding mechanism
4 Top belt
4*a* Top belt strand
4*b* Top belt strand
5 Bottom belt
6 Core
7 Top face
8 Top layer
9 Bottom face
10 Running surface facing
11 Control edge
12 Control edge
13 Width
14. Recess
15 Arrow
16 Axis
17 Deformation portion
18 Base
19 Width
20 Adjusting means
21 Support means
22 Support element
23 Axis
24 Support body
25 Support surface
26 Support surface
27 Longitudinal side wall
28 Longitudinal side wall
29 Double arrow
30 Double arrow
31 Flange nut arrangement
32 Threaded bush
33 Threaded pin
34 Connecting element
35 Coupling mechanism
36 Coupling mechanism
37 Bush-type coupling element
38 Bush-type coupling element
39 Pin-type coupling element
40 Pin-type coupling element
41 Catch or lock mechanism
42 Catch or lock mechanism
43 Guide element
44 Guide element
45 Projection
46 Projection
47 Free space
48 Free space
49 Spring element
50 Spring element
51 Camber
52 Camber
53 Support or guide surface
54 Support or guide surface
55 Recess
56 Recess
57 Slide element
58 Guide mechanism
59 Thrust surface
60 Thrust surface
61 Projection
62 Projection
63 Prizing means
64 Pulling means
65 Lever or gear arrangement
66 Pivot lever
67 Axis
68 Motion transmitting arm
69 Linking axis
70 Slide track
71 Slide track

72 Threaded spindle arrangement
73 Rotary bearing
74 Threaded bush
75 Threaded spindle
76 Operating element
77 Facing element
78 Threaded spindle arrangement
79 Transverse bore
80 Transverse bore
81 Folding lever
82 Eccentric cam
83 Pivot shaft
84 Indentation
85 Indentation
86 Threaded spindle arrangement
87 Anchoring element
88 Anchoring element
89 Section
90 Section

What is claimed is:

1. Ski or snowboard in the form of a board-type gliding device, comprising at least one top belt for imparting strength, at least one bottom belt for imparting strength and at least one core disposed in between, a top layer constituting the top face of the gliding device and a running surface constituting the bottom face of the gliding device, and, by reference to the width of the gliding device, at least one recess is provided in its middle portion extending in its depth direction from the top face of the gliding device in the direction towards the running surface and disposed in its longitudinal direction essentially parallel with the longitudinal direction of the gliding device with a view to causing a cross sectional weakening and reducing the stiffness of the gliding device transversely to its longitudinal direction, being provided with means for producing a cross-sectional shape or contour of the gliding device which is variable depending on load and/or manually variable, wherein at least one manually adjustable adjusting means is provided, which is designed on the one hand to act as a spreading means for producing an individually pre-adjustable increase in the width of the recess and on the other hand to act as a pulling means for producing an individually pre-adjustable reduction in the width of the recess, and the adjusting means selectively acts as an active spreading means or an active pulling means between the portions of the gliding device lying to the left and right of the recess depending on its individually selectable setting and wherein the at least one manually adjustable adjusting means, which is made of one piece and is moveable along the longitudinal axis of the gliding device, has at least two support or guide surfaces extending obliquely with respect to the longitudinal axis and perpendicular with respect to the running surface of the gliding device, which support surfaces cooperate with thrust surfaces on the top face of the gliding device or with longitudinal side walls of the groove-type recess so that when the adjusting means is shifted along the longitudinal axis, the support surfaces slide along the thrust surfaces or the longitudinal side walls and the recess is spread and pulled, respectively.

2. Ski or snowboard according to claim 1, wherein the recess divides or splits the strength imparting top belt essentially within its longitudinal extension into a first or left-hand and a second or right-hand top belt strand.

3. Ski or snowboard according to claim 1, wherein the recess extends from the top face in the depth direction as far as the bottom belt or weakens or reduces the cross-section of the bottom belt, and the running surface extends at least within the longitudinal extension of the recess starting from the left-hand side edge of the gliding device continuously as far as the right-hand side edge of the gliding device.

4. Ski or snowboard according to claim 1, wherein the recess extends across 50% to 90%, preferably across approximately 75%, of the biggest cross-sectional height of the gliding device within this cross-sectional plane.

5. Ski or snowboard according to claim 1, wherein the recess or several recesses aligned in a row in the longitudinal direction of the gliding device extends or extend across 40% to 80%, preferably across approximately 60%, of the length of the gliding device.

6. Ski or snowboard according to claim 1, wherein the recess extends across 50% to 90%, preferably across approximately 75%, of the front longitudinal portion between a binding mechanism and the front end of the gliding device.

7. Ski or snowboard according to claim 1, wherein the recess, which runs continuously or discontinuously, extends as far as the front, upwardly curved shovel portion and extends through at least part-portions of the upwardly extending curvature of the front shovel portion and reduces the transverse stiffness of the front shovel portion.

8. Ski or snowboard according to claim 1, wherein a depth of the recess decreases, starting from a mounting portion for a binding mechanism in the direction towards the rear end and/or in the direction towards the front shovel portion of the gliding device.

9. Ski or snowboard according to claim 1, wherein a base of the recess is of a crease-type shape or is of a rounded design.

10. Ski or snowboard according to claim 1, wherein the adjusting means is designed to vary a width of the recess on an individually pre-settable basis and selectively to permit and to prevent and/or limit a load-dependent variability of the width of the recess.

11. Ski or snowboard according to claim 1, wherein the thrust surfaces are provided in the form of projections fixedly joined to the board-type gliding device.

12. Ski or snowboard according to claim 1, wherein the adjusting means can be switched between an inactive position and at least one active position and vice versa, and when the adjusting means is in an active position, support surfaces are activated in order to provide support between the left-hand and right-hand portions of the gliding device and prevent a load-dependent reduction in the width of the recess or to afford an elastic resistance to a load-dependent reducing movement in the width of the recess.

13. Ski or snowboard according to claim 1, wherein the adjusting means has a lever or gear arrangement for transferring the adjusting means from the inactive position into at least one active position with additional force.

14. Ski or snowboard according to claim 13, wherein the lever or gear arrangement is designed to be operated without tools.

15. Ski or snowboard according to claim 1, wherein the top layer is provided in the form of a plastic layer and lines the longitudinal side walls and base of the recess.

16. Ski or snowboard according to claim 1, wherein the top layer is provided as a one-piece plastic layer which extends from the top face down to the base of the recess and back up to the top face of the gliding device.

* * * * *